US010211579B2

(12) United States Patent
Zhu et al.

(10) Patent No.: US 10,211,579 B2
(45) Date of Patent: Feb. 19, 2019

(54) POWER PLUG

(71) Applicant: SHANUTEC (SHANGHAI) CO., LTD., Shanghai (CN)

(72) Inventors: Wenting Zhu, Shanghai (CN); Guoxin Wu, Shanghai (CN); Nan Luo, Shanghai (CN); Quangang Zhang, Shanghai (CN); Bowei Lu, Shanghai (CN); Yan Chen, Shanghai (CN); Juan Cheng, Shanghai (CN); Shiwen Liu, Shanghai (CN); Furong Qiu, Shanghai (CN); Jiajie Shen, Shanghai (CN); Enhua Geng, Shanghai (CN)

(73) Assignee: SHANUTEC (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 15/748,168

(22) PCT Filed: Jul. 28, 2016

(86) PCT No.: PCT/CN2016/092051
§ 371 (c)(1),
(2) Date: Jan. 26, 2018

(87) PCT Pub. No.: WO2017/016504
PCT Pub. Date: Feb. 2, 2017

(65) Prior Publication Data

US 2018/0261963 A1 Sep. 13, 2018

(30) Foreign Application Priority Data

Jul. 28, 2015 (CN) ..... 2015 1 0451658
Aug. 19, 2015 (CN) ..... 2015 2 0627631 U
Aug. 19, 2015 (CN) ..... 2015 2 0627632 U

(51) Int. Cl.
*H01R 13/00* (2006.01)
*H01R 24/60* (2011.01)
(Continued)

(52) U.S. Cl.
CPC ..... *H01R 24/60* (2013.01); *H01R 13/04* (2013.01); *H01R 13/6335* (2013.01);
(Continued)

(58) Field of Classification Search
CPC . H01L 23/4006; F21V 29/004; H01R 23/688; H01R 13/65802; H01R 23/6873
(Continued)

(56) References Cited

U.S. PATENT DOCUMENTS 3,193,636 A 7/1965 Daniels
8,075,321 B1 * 12/2011 Costello ..... H01R 12/79 439/77
(Continued)

FOREIGN PATENT DOCUMENTS

CN 2309642 Y 3/1999
CN 2479666 Y 2/2002
(Continued)

OTHER PUBLICATIONS

International Search Report in PCT/CN2016/092051 dated Nov. 4, 2016, 5 pages.
(Continued)

*Primary Examiner* — Phuong Chi T Nguyen
(74) *Attorney, Agent, or Firm* — Metis IP LLC

(57) ABSTRACT

A power plug is provided. The power plug may include a plug insert having a handle, and a plug body including a plurality of insulation layers and a plurality of conducting strips sandwiched between the pluralities of insulation layers. Each of the plurality of conducting strips may have an end extending into the handle and the other end forming or
(Continued)

electrically connected to a conducting contact point exposed on a surface of the plug body.

18 Claims, 26 Drawing Sheets

(51) Int. Cl.
*H01R 13/633* (2006.01)
*H01R 31/06* (2006.01)
*H01R 13/04* (2006.01)
*H01R 24/40* (2011.01)
*H01R 24/58* (2011.01)

(52) U.S. Cl.
CPC ..... *H01R 24/40* (2013.01); *H01R 24/58* (2013.01); *H01R 31/06* (2013.01)

(58) Field of Classification Search
USPC .... 439/485, 487, 7–607, 11, 607.28, 607.35, 439/607.4
See application file for complete search history.

(56) References Cited

U.S. PATENT DOCUMENTS

| | | | | |
|---|---|---|---|---|
| 8,944,845 | B2 | 2/2015 | Yu et al. | |
| 9,466,924 | B2 * | 10/2016 | Lin | H01R 13/6585 |
| 9,525,243 | B1 * | 12/2016 | Yuan | H01R 13/6585 |
| 9,997,869 | B2 * | 6/2018 | Zhang | H01R 13/6585 |
| 2005/0014404 | A1 | 1/2005 | Cecchi | |
| 2010/0035448 | A1 | 2/2010 | Nishimura | |
| 2010/0062652 | A1 | 3/2010 | Liu | |
| 2016/0104957 | A1 * | 4/2016 | Kim | H01R 13/5219 439/78 |
| 2016/0111821 | A1 * | 4/2016 | Lan | H01R 13/646 439/607.01 |

FOREIGN PATENT DOCUMENTS

| | | | |
|---|---|---|---|
| CN | 101431205 | A | 5/2009 |
| CN | 201319433 | Y | 9/2009 |
| CN | 201392905 | Y | 1/2010 |
| CN | 101847789 | A | 9/2010 |
| CN | 201956483 | U | 8/2011 |
| CN | 102904099 | A | 1/2013 |
| CN | 203180135 | U | 9/2013 |
| CN | 203288806 | U | 11/2013 |
| CN | 203839641 | U | 9/2014 |
| CN | 104993269 | A | 10/2015 |
| CN | 204834963 | U | 12/2015 |
| CN | 204834963 | U | 12/2015 |
| CN | 204927731 | U | 12/2015 |
| CN | 204927761 | U | 12/2015 |
| DE | 2814310 | A1 | 10/1979 |
| WO | 03005493 | A1 | 1/2003 |

OTHER PUBLICATIONS

Written Opinion in PCT/CN2016/092051 dated Nov. 4, 2016, 5 pages.
First office action for Chinese application No. 201510451658.9 dated Dec. 26, 2016, 22 pages.
Second office action for Chinese application No. 201510451658.9 dated Aug. 22, 2017, 18 pages.
The extended European search report in Europen Application No. 16829869.3 dated Sep. 14, 2018, 8 pages.

* cited by examiner

POWER PLUG

CROSS-REFERENCE TO RELATED APPLICATIONS

This application is a U.S. national stage of International Application No. PCT/CN2016/092051, filed on Jul. 28, 2016, which claims priority to Chinese Application No. 201510451658.9, filed on Jul. 28, 2015, Chinese Application No. 201520627631.6, filed on Aug. 19, 2015, and Chinese Application No. 201520627632.0, filed on Aug. 19, 2015. Each of the above-referenced applications is incorporated herein by reference in its entirety.

TECHNICAL FIELD

The present disclosure relates to power plugs.

BACKGROUND

Power plugs are widely used in daily life. Traditional power plugs generally have sharp pins. The sharp pins may occupy space and be exposed. Traditional power plugs may be inconvenient to carry around.

SUMMARY

In some embodiments, the power plug may include a plug insert having a handle, and a plug body. The plug body may include a plurality of insulation layers and a plurality of conducting strips sandwiched between the pluralities of insulation layers. A conducting strip may have an end extending into the handle and the other end forming or electrically connected to a conducting contact point exposed on a surface of the plug body.

In some embodiments, the end extending into the handle may form a power port or connect to a power line.

In some embodiments, an insulation layer may include a conducting hole on the surface of the insulation layer for exposing the conducting contact point connected to the conducting strip.

In some embodiments, the power plug may include three conducting strips forming three conducting contact points. The three conducting contact points may be electrically connected to a hot wire, a neutral wire, and a ground wire, respectively.

In some embodiments, the handle may include a wiring path. The end of a conducting strip extending into the handle may extend into the wiring path in the handle.

In some embodiments, the power plug may further include a connector having a cross-section that matches a cross-section of at least a portion of the wiring path in the handle. The connector may further include a plurality of electrical connecting strips. The electrical connecting strips of the connector and the plurality of conducting strips of the plug insert may be electrically connected to form a power port.

In some embodiments, the connector may further include a bulge in the cross-section that may match the cross-section of at least a portion of the wiring path so that the connector is secured in the handle. In some embodiments, the bulge may be connected to the handle by inserting, screwing, a rotary joint, or the like, or a combination thereof.

In some embodiments, the number of the conducting contact points may be at least two. The at least two of the conducting contact points may be formed on a same surface of the plug body. The at least two conducting contract points may be formed on different surfaces of the plug body. In some embodiments, at least one conducting contract point may be formed on a bottom surface of the plug body.

In some embodiments, the power plug may further include a protective sleeve covering the plug body.

In some embodiments, at least one of the conducting contact points may be retractable.

In some embodiments, the power plug may include a connector and a plug insert. The connector may have an insertion column. A plurality of outer contact points may be formed on the insertion column. A power port may be formed on the connector. The plug insert may have a handle with an insertion opening matching the insertion column. The insertion opening may have a plurality of inner contact points formed inside the insertion opening and a plug body with a plurality of conducting contact points formed on one or more surfaces of the plug body.

In some embodiments, the power plug may further include a plurality of insertion grooves formed on an inner wall of the insertion opening and a plurality of slots formed near the bottom of each insertion groove. The number of the plurality of insert grooves may equal to the number of the plurality of outer contact points. The plurality of slots may have a plurality of inner contact points formed on the bottom surface of the plurality of slots. The slots may be configured to accommodate the insertion grooves.

In some embodiments, the plug body may include a plurality of conducting strips formed inside the plug body. A conducting strip may have a first end and a second end. The first end of the conducting strip may form or be electrically connected to a conducting contact point. The second end of the conducting strip may extend into the insertion opening to form or be electrically connected to an inner contact point of the plurality of inner contact points.

In some embodiments, the connector may include a plurality of electrical connecting strips formed inside the connector. An electrical connecting strip may have a third end and fourth end. The third end of the electrical conducting strip may form or be electrically connected to an outer conducting contact point on the insertion column. The fourth end of the electrical conducting strip may form a power port in the connector.

In some embodiments, the number of the inner contact points, the number of the plurality of outer contact points, and the number of the conducting contact points may be equal.

In some embodiments, the power plug may further include a plurality of outer contact circles formed on an upper edge of the insertion column, and a plurality of inner contact circles formed on an upper edge of the insertion opening. The plurality of conducting contact points may be connected to at least two of the insertion opening, the plurality of inner contact circles, and the plurality of outer contact circles.

In some embodiments, the power plug may further include a plurality of outer screw threads formed on an outer wall of the insertion column, and a plurality of inner screw threads formed on the inner wall of the insertion opening. The plurality of inner screw threads and the plurality of outer screw threads may be configured to match each other so that the insertion column can be screwed into the insertion opening.

In some embodiments, the plug body may include three conducting strips formed inside the plug body. A conducting strip may have a fifth end and a sixth end. The fifth end of a conducting strip may form or be electrically connected to a conducting contact point on a surface of the plug body.

Three sixth ends of the three conducting strips may form the insertion opening, the inner contact point, and the inner contact circle, respectively.

In some embodiments, the insertion column, the plurality of outer contact points, and the plurality of outer contact circles in the connector may be connected to the power port on the connector.

In some embodiments, the power plug may further include a protective sleeve covering the plug body.

Additional features will be set forth in part in the description which follows, and in part will become apparent to those skilled in the art upon examination of the following and the accompanying drawings or may be learned by production or operation of the examples. The features of the present disclosure may be realized and attained by practice or use of various aspects of the methodologies, instrumentalities and combinations set forth in the detailed examples discussed below.

BRIEF DESCRIPTION OF THE DRAWINGS

Various objects, features, and advantages of the disclosed subject matter may be more fully appreciated with reference to the following detailed description of the disclosed subject matter when considered in connection with the following drawings, in which like reference numerals identify like elements.

DETAILED DESCRIPTION

In the following detailed description, numerous specific details are set forth by way of examples in order to provide a thorough understanding of the relevant disclosure. However, it should be apparent to those skilled in the art that the present disclosure may be practiced without such details. In other instances, well known methods, procedures, systems, components, and/or circuitry include been described at a relatively high-level, without detail, in order to avoid unnecessarily obscuring aspects of the present disclosure. Various modifications to the disclosed embodiments will be readily apparent to those skilled in the art, and the general principles defined herein may be applied to other embodiments and applications without departing from the spirit and scope of the present disclosure. Thus, the present disclosure is not limited to the embodiments shown, but to be accorded the widest scope consistent with the claims.

The terminology used herein is for the purposes of describing particular examples and embodiments only, and is not intended to be limiting. As used herein, the singular forms "a," "an," and "the" may be intended to include the plural forms as well, unless the context clearly indicates otherwise. It will be further understood that the terms "include," and/or "comprise," when used in this disclosure, specify the presence of integers, devices, behaviors, stated features, steps, elements, operations, and/or components, but do not exclude the presence or addition of one or more other integers, devices, behaviors, features, steps, elements, operations, components, and/or groups thereof.

Figure 1:
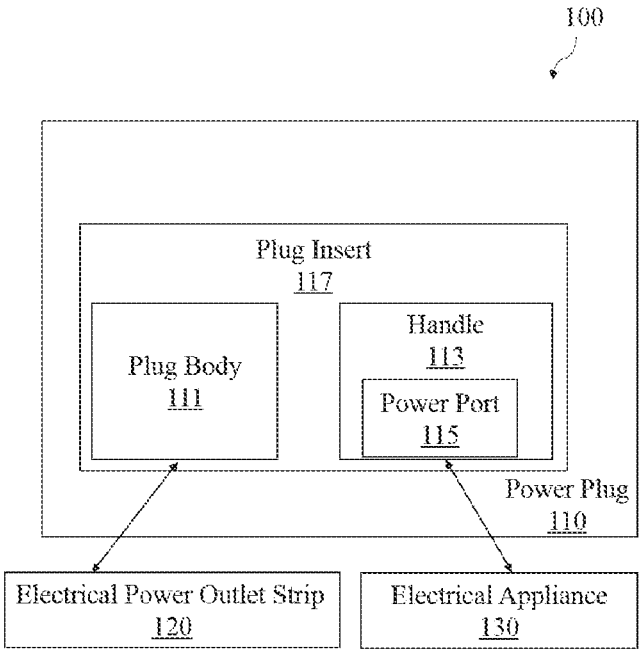
FIG. 1 illustrates an exemplary electrical system in accordance with some embodiments of this disclosure.

FIG. 1 illustrates an exemplary electrical system in accordance with some embodiments of this disclosure. As illustrated, electrical system 100 may include, among other devices, a power plug 110, an electrical power outlet strip 120, and electrical appliance 130.

Power plug 110 may transmit electrical power from electrical power outlet strip 120 to electrical appliance 130. Power plug 110 may include a plug insert 117. Plug insert 117 may include, among other components, a plug body 111 and a handle 113. In some embodiments, plug body 111 may include one or more insulation layers (not shown) and one or more conducting strips (not shown). The conducting strip(s) may be placed on an insulation layer. In some embodiments, the conducting strip(s) may be sandwiched between two insulation layers.

In some embodiments, the conducting strip(s) may be electrically connected to one or more conducting contact points. In some embodiments, the insulation layer(s) may have one or more conducting holes on its surface. The conducting holes may be configured so that conducting contact points may be exposed on one or more surfaces of plug body 111. A conducting contact point may be electrically connected to a hot wire, a neutral wire, or a ground wire. A conducting contact point may be retractable. In some embodiments, a conducting contact point may be pushed inwards when a force is applied on it. The conducting contact points and conducting strip(s) may be separated parts electrically connected to each other, or formed as an integral piece.

In some embodiments, the conducting contact points may be formed on a same surface of plug body 111. Alternatively, at least one of the conducting contact points may be on a different surface of plug body 111 than at least one of the conducting contact points. In some embodiments, at least one of the conducting contact points may be formed on the bottom surface of plug body 111.

In some embodiments, plug body 111 may have a first conducting strip electrically connected to a hot wire through a first conducting contact point, and a second conducting strip electrically connected to a neutral wire through a second conducting contact point. In some embodiments, plug body 111 may further include a third conducting strip electrically connected to a ground wire through a third conducting contact point.

In some embodiments, insulation layers 205*a* and/or 205*b* may be manufactured using any suitable material including, for example, plastic, fiber, any other non-conductive material, or the like, or any combination thereof. In some embodiments, the conducting strips may be manufactured using any suitable material including, for example, such as metal (e.g., copper, aluminum, gold, etc.), an alloy, any other conductive material, or the like, or any combination thereof. In some embodiments, a conducting contact point may be formed using any suitable material including, for example, metal (e.g., copper, aluminum, gold, etc.), an alloy, any other conductive material, or the like, or any combination thereof. In some embodiments, the conducting strips (e.g., 213*a*, 213*b*, 213*c*, etc.) and conducting contact points (e.g., 207*a*, 207*b*, 207*c*, etc.) may be made of a same material or different materials.

In some embodiments, handle 113 may include one or more power ports 115. Power port(s) 115 may be electrically connected to one end of the conducting strip. In some embodiments, power port 115 may be an electrical connection port that may include a columnar hole, a USB hole, a connection port connecting to a conducting wire, or the like, or a combination thereof. In some embodiments, plug body 111 and handle 113 may be formed as an integral part. Plug body 111 may be retractable. In some embodiments, plug body 111 may be removed from handle 113. In some embodiments, plug body 111, handle 113 and the conducting wire are formed as an integral part. In some embodiments, handle 113 may be manufactured using any suitable material including, for example, plastic, fiber, any another non-conductive material, or the like, or any combination thereof.

In some embodiments, plug body 111 may be retractable. Plug body 111 may have two configurations, an extended configuration in which plug body 111 extends out of handle 113, and a retracted configuration in which plug body 111 is partially or entirely retracted into handle 113. In some embodiments, plug body 111 may be removable attached to handle 113. For instance, plug body 111 may be removed from handle 113 for, for example, storage or transportation, and plug body 111 may be attached to handle 201 for, for example, use.

In some embodiments, electrical power outlet strip 120 may include one or more conductors that may transmit electrical power from the power source (e.g., a DC power source, an AC-to-DC power source, an AC power source, etc.) to electrical appliance 130 via power plug 110. The one or more conductors may refer to a hot wire, a neutral wire, and/or a ground wire. In some embodiments, the conductors may also include a data cable, a network cable, an audio/video cable, or the like, or a combination thereof. The conductors may be hard, difficult to deform.

In operation, plug body 111 may be inserted into electrical power outlet strip 120 through an opening. The conducting contact points in plug body 111 may be in contact with the conductors of electrical power outlet strip 120 to establish an electrical connection between electrical power outlet strip 120 and power plug 110. As a result, power port 115 may be electrically connected to the conductors in electrical power outlet strip 120.

Electrical appliance 130 may be electrically connected to the power source when it is connected to power port 115 of handle 113. Electrical appliance 130 may be a cellphone to be charged, a laptop, a TV, a refrigerator, an air conditioner, a microwave woven, etc. Electrical appliance 130 may be electrically connected to the power source via an extension strip that is electrically connected to power port(s) 115.

Figure 2A:
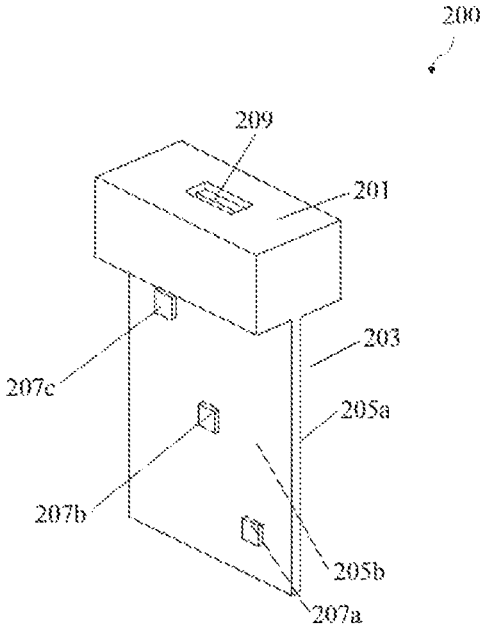
FIG. 2A illustrates an exemplary power plug in accordance with some embodiments of this disclosure.

FIG. 2A illustrates an exemplary power plug according to some embodiments of this disclosure. Power plug 200 may include, among other components, a handle 201 and a plug body 203.

In some embodiments, plug body 203 may include a piece that may be inserted into electrical power outlet strip 120. Plug body 203 may include two or more insulation layers 205*a* and 205*b*, and one or more conducting strips (not shown) sandwiched between insulation layers 205*a* and 205*b*. In some embodiments, the conducting strip(s) may include one or more conducting contact points. A conducting strip and a conducting contact point may be formed as an integral piece. In some embodiments, a conducting strip and a conducting contact point may be separated parts electrically connected to each other. Conducting contact point 207*a*, 207*b*, or 207*c* may be electrically connected to a hot wire, a neutral wire, or a ground wire. In some embodiments, Conducting contact point 207*a*, 207*b*, or 207*c* may be retractable. Conducting contact point 207*a*, 207*b*, or 207*c* may be pushed inwards when a force is applied on it.

In some embodiments, conducting contact points 207*a*, 207*b*, and 207*c* are on the same surface of plug body 203. Alternatively, at least one of conducting contact points 207*a*, 207*b*, and 207*c* may be formed on a different surface of plug body 111 than at least another conducting contact points 207*a*, 207*b*, and 207*c*. In some embodiments, at least one of conducting contact points 207*a*, 207*b*, and 207*c* may be formed on the bottom surface of plug body 111.

In some embodiments, insulation layer 205*b* may be referred to as a top insulation layer, and insulation layer 205*a* may be referred to as a bottom insulation layer. Conducting contact points 207*a*, 207*b* and 207*c* may include a hot wire conducting contact point electrically connected to a hot wire, a neutral wire conducting contact point electrically connected to a neutral wire, and a ground wire conducting contact point electrically connected to a ground wire.

For example, conducting contact point 207*a* may be a hot wire conducting contact point, conducting contact point 207*b* may be a neutral wire conducting contact point, and the conducting contact point 207*c* may be a ground wire conducting contact point. As another example, conducting contact point 207*a* may be the neutral wire conducting contact point, conducting contact point 207*b* may be the ground wire conducting contact point, and conducting contact point 207*c* may be the hot wire conducting contact point. In some embodiments, the hot wire conducting contact point may be, among the hot wire conducting contact point, the neutral wire conducting contact point, and the ground wire conducting contact point, closest to the insertion end of plug body 203. The insertion end is the first part in plug body 203 to insert into electrical power outlet strip 120. As illustrated in FIG. 2A, the distances between different conducting contact points (e.g., 207*a*, 207*b*, 207*c*, etc.) and the insertion end may be different. In some embodiments, the distances between different conducting contact points (e.g. 207*a*, 207*b*, 207*c*) and the insertion end may be the same.

In some embodiments, the shape of plug body 203 may be cuboid, cylinder, ellipsoid, or the like, or any combination thereof. The process of manufacturing plug body 203 may include laser cutting, integral forming, gluing, or the like, or any combination thereof.

In some embodiments, insulation layers 205*a* and/or 205*b* may be manufactured using any suitable material including, for example, plastic, fiber, any another non-conductive material, or the like, or any combination thereof.

In some embodiments, a conducting strip may be manufactured using any suitable material including, for example, metal (e.g., copper, aluminum, gold, etc.), an alloy, any other conductive material, or the like, or any combination thereof. The shape of a conducting strip may include, for example, cuboid, cylinder, ellipsoid, the like, or any combination thereof. The shape of conducting contact points 207*a*, 207*b* and/or 207*c* may include, for example, cuboid, cylinder, ellipsoid, or the like, or any combination thereof. The conducting contact points 207*a*, 207*b* and/or 207*c* may be manufactured using any suitable material including, for example, metal (e.g., copper, aluminum, gold, etc.), an alloy, any other conductive material, or the like, or any combination thereof.

In some embodiments, handle 201 may include one or more power ports 209 (although one power port 209 is illustrated in FIG. 2A) that are electrically connected to the conducting strips of plug body 203. Power port 209 may electrically connect electrical appliance 130 or to the power source through one or more conducting strips (and conducting contact points 207*a*, 207*b* and 207*c*). Merely by way of example, power port 209 may be a USB port that may be used for charging and/or connecting to electrical appliance 130 (e.g., a mobile phone, a tablet, etc.).

In some embodiments, plug body 203 may be retractable. Plug body 203 may have two configurations, an extended configuration in which plug body 203 extends out of handle 201, and a retracted configuration in which plug body 203 is partially or entirely retracted into handle 201. In some embodiments, plug body 203 may be removable attached to handle 201. For instance, plug body 203 may be removed from handle 201 for, for example, storage or transportation, and plug body 203 may be attached to handle 201 for, for example, use.

In some embodiments, the shape of handle 201 may include, for example, cuboid, cylinder, ellipsoid, or the like, or any combination thereof. As another example, electrical appliance 130 may include, for example, a TV, a refrigerator, an air conditioner, a microwave woven, etc. Electrical appliance 130 may be electrically connected to the power source via an extension strip that is electrically connected to power port(s) 209.

Figure 2B:
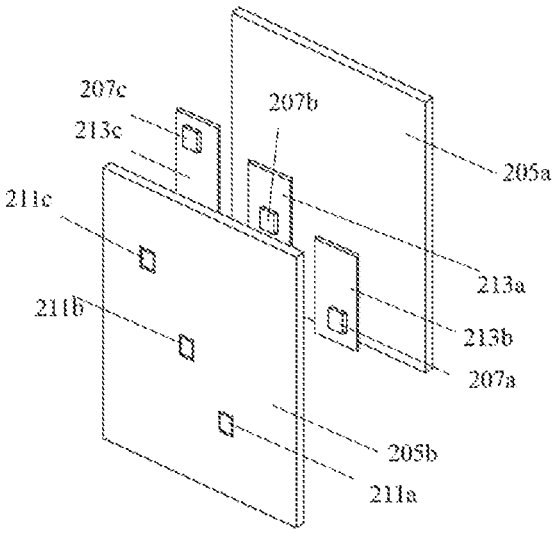
FIG. 2B illustrate an exploded view of an exemplary plug body in accordance with some embodiments of this disclosure.

FIG. 2B illustrates an exploded view of an exemplary plug body in accordance with some embodiments of this disclosure. Plug body 203 may include two insulation layers 205*a*, 205*b* and three conducting strips 213*a*, 213*b*, and 213*c* sandwiched between insulation layers 205*a* and 205*b*. A conducting strip may include or be electrically connected with a conducting contact point 207*a*, 207*b* or 207*c*. One of the insulation layer 205*a* may include three conducting holes 211*a*, 211*b*, and 211*c* on its surface. Conducting holes 211*a*, 211*b* and 211*c* may be configured such that conducting contact points 207*a*, 207*b* and 207*c* may be exposed on the surface of insulation layer 205.

In some embodiments, conducting hole 211*a*, 211*b*, or 211*c* may be formed on one or more insulation layers 205*a* and 206*b*. Alternatively, at least one of the conducting holes may be on a different insulation layer 205*a* or 205*b* than at least another conducting hole.

Figure 3:
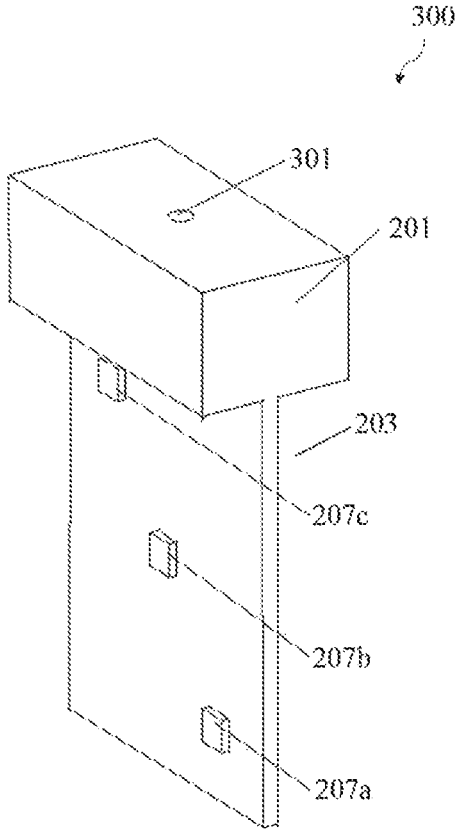
FIG. 3 illustrates an exemplary power plug in accordance with some embodiments of this disclosure.

FIG. 3 illustrates an exemplary power plug in accordance with some embodiments of this disclosure. As shown, power plug 300 is similar to power plug 200 (discussed above with reference to FIG. 2A), except for certain components or features.

For example, power port 301 may be a hole used for charging and/or connecting to electrical appliance 130. In some embodiments, the shape of the hole may be, for example, circle, rectangle, square, or the like, or any combination thereof.

Figure 4A:
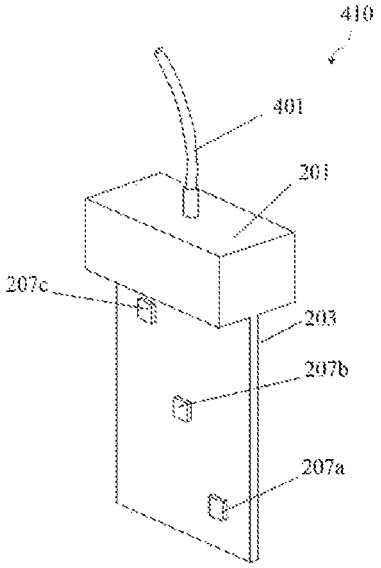
FIG. 4A illustrates an exemplary power plug in accordance with some embodiments of this disclosure.

FIG. 4A illustrates an exemplary power plug in accordance with some embodiments of this disclosure. As shown, power plug 410 is similar to power plug 300 (discussed above with reference to FIG. 3), except for certain components or features.

For example, handle 201 may be electrically connected to a power line 401 directly. Power line 401 may be electrically connected to the one or more conducting strips to establish an electrical connection between electrical power outlet strip 120 and power line 401. Power line 401 may be electrically connected to electrical appliance 130. As a result, power line 401 may transmit electrical power from electrical power outlet strip 120 to electrical appliance 130.

Figure 4B:
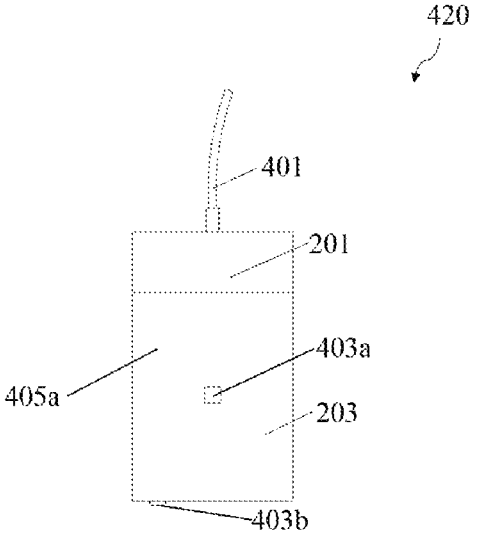
FIG. 4B illustrates the rear view of an exemplary power plug in accordance with some embodiments of this disclosure.

FIG. 4B illustrates the rear view of an exemplary power plug in accordance with some embodiments of this disclosure. Power plug 420 may include, among other components, a handle 201 and a plug body 203.

As shown, power plug 420 is similar to power plug 410 (discussed above with reference to FIG. 4A). For example, at least one of the conducting contact points may be on a different surface of plug body 203 than at least another conducting contact point. Conducting contact point 403*a* may be on surface 405*a*. Surface 405*a* may be the surface of an insulation layer of plug body 203. Conducting contact point 403*b* may be on the bottom surface of plug body 203.

In some embodiments, conducting contact points 403*a* and 403*b* may be arranged in other forms. The number of conducting contact points (e.g., 403*a*, 403*b*) may be at least two and variable.

Figure 4C:
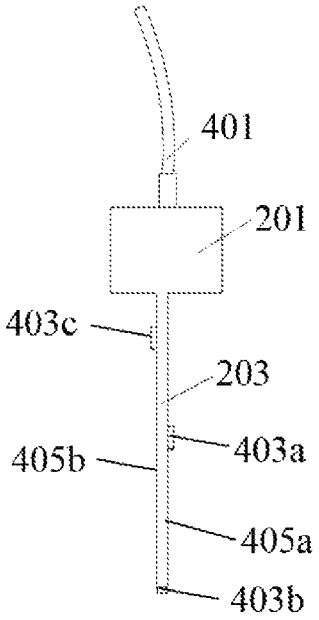
FIG. 4C and FIG. 4D respectively illustrate the side view and the bottom view of an exemplary power plug in accordance with some embodiments of this disclosure.
Figure 4D:
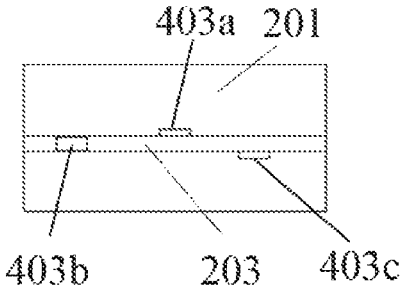

FIG. 4C and FIG. 4D respectively illustrate the side view and the bottom view of an exemplary power plug in accordance with some embodiments of this disclosure. The power plug may include a handle 201 and a plug body 203.

As illustrated in FIG. 4C and FIG. 4D, the plug body 203 may include conducting contact points 403*a* through 403*c* on different surfaces of plug body 203. Conducting contact points 403*a* through 403*c* may be formed on surfaces 405*a*, 405*b*, and the bottom surface of plug body 203. Surface 405*b* may be part of an insulation layer of plug body 203. Surface 405*a* may be part of another insulation layer of plug body 203. For example, as illustrated in FIG. 4C and FIG. 4D, conducting contact point 403*a* may be formed on surface 405*a* of plug body 203, and conducting contact point 403*c* may be formed on surface 405*b* of plug body 203. In some embodiments, conducting contact point 403*b* may be on the bottom surface of plug body 203.

In some embodiments, conducting contact points 403*a*, 403*b*, and 403*c* may be arranged in any form different from that shown in FIG. 4C and FIG. 4D. The number of conducting contact points (e.g., 403*a*, 403*b*, 403*c*, etc.) may be at least two and variable.

Figure 4E:
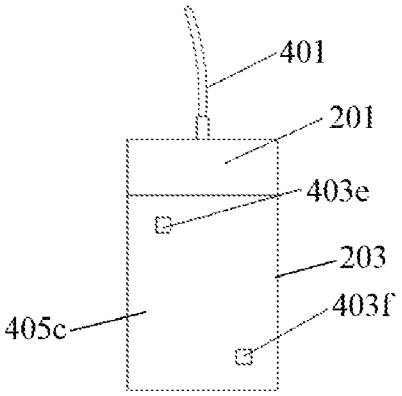
FIG. 4E and FIG. 4F respectively illustrate the front view and the side view of an exemplary power plug in accordance with some embodiments of this disclosure.
Figure 4F:
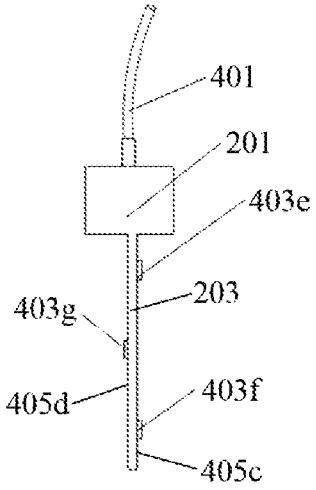

FIG. 4E and FIG. 4F respectively illustrate the front view and the side view of an exemplary power plug in accordance with some embodiments of this disclosure.

The power plug may include a handle 201 and a plug body 203. The power plug illustrated in FIG. 4E and FIG. 4F is similar to power plug 420 (discussed above with reference to FIG. 4B), except for certain components or features.

In some embodiments, conducting contact points 403*e*, 403*f* and 403*g* may be formed on surfaces 405*c* and 405*d* of plug body 203. Surface 405*c* and 405*d* may be part of two insulation layer of plug body 203, respectively. For example, conducting contact points 403*e* and 403*f* may be formed on surface 405*c* of plug body 203. In some embodiments, conducting contact point 403*g* may be formed on surface 405*d* of plug body 203.

Alternatively, conducting contact points 403*e* and 403*f* may be formed on surface 405*d* of plug body 203. Conducting contact point 403*g* may be formed on surface 405*c* of plug body 203. In some embodiments, conducting contact points 403*e* and 403*g* may be both formed on surface 405*c* or surface 405*d*.

In some embodiments, conducting contact points 403*e*, 403*f*, and 403*g* may be arranged in any form other than that shown in FIG. 4E and FIG. 4F. The number of conducting contact points (e.g. 403*e*, 403*f*, 403*g*, etc.) may be at least two and variable.

Figure 5A:
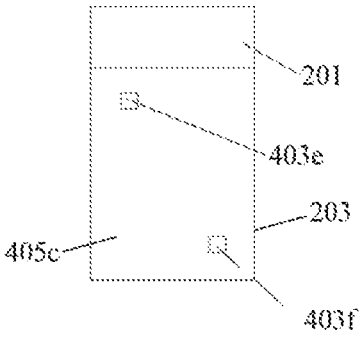
FIG. 5A and FIG. 5B respectively illustrate the front view and the side view of an exemplary power plug in accordance with some embodiments of this disclosure.
Figure 5B:
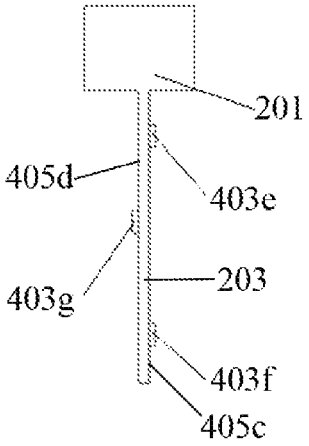

FIG. 5A and FIG. 5B respectively illustrate the front view and the side view of an exemplary power plug in accordance with some embodiments of this disclosure.

The power plug as illustrated in FIG. 5A and FIG. 5B may include a handle 201 and a plug body 203. The power plug in the front view the side view is similar to the power plug as illustrated in FIG. 4E and FIG. 4F and the description thereof, except for certain components or features.

For example, two insulation layers of the plug body 203 may be formed as an integral part. The conducting strips sandwiched between the two insulation layers may extend to the power port in handle 201. The power port may be used for charging and/or connecting to electrical appliance 130.

In some embodiments, the conducting strips may be sandwiched between two insulation layers. In some embodiments, the conducting strips may include (or referred to as form) or be electrically connected to one or more conducting contact points (e.g. 403*e*, 403*f*, 403*g*, etc.). Conducting contact points 403*e*, 403*f*, and 403*g* may be all formed on one of two surfaces 405*c* and 405*d*.

Alternatively, conducting contact points 403*e*, 403*f*, and 403*g* may be formed on two surfaces 405*c* and 405*d*, respectively. For example, conducting contact points 403*e* and 403*f* may be formed on surface 405*c*. Conducting contact points 403*g* may be formed on surface 405*d*. A conducting contact points 403*e*, 403*f*, or 403*g* and the conducting strip may be separated parts electrically connected to each other, or formed as an integrated piece.

In some embodiments, conducting contact points 403*e*, 403*f*, and 403*g* may be arranged in any form other than that illustrate in FIG. 5A and FIG. 5B. The number of conducting contact points (e.g. 403*e*, 403*f*, 403*g*, etc.) may be at least two and variable.

Figure 6:
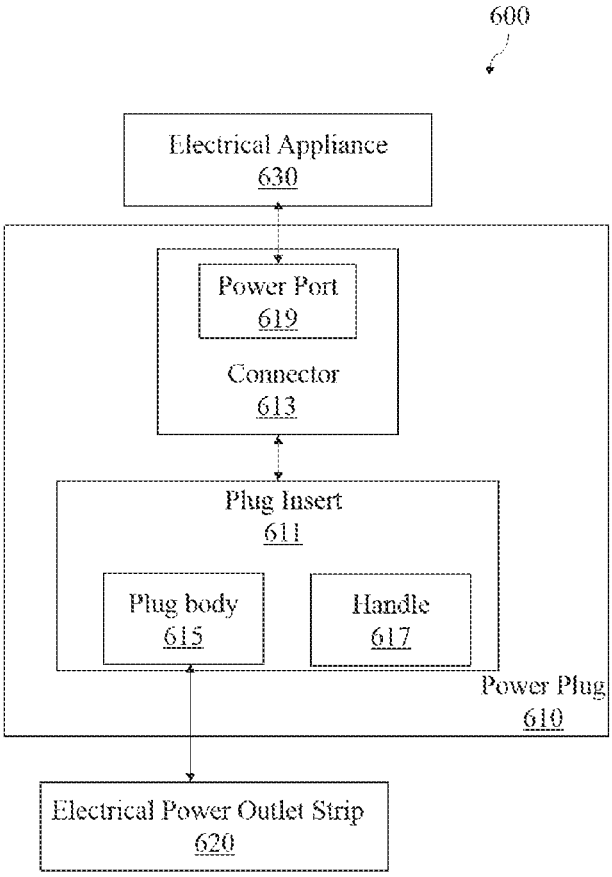
FIG. 6 illustrates an exemplary electrical system in accordance with some embodiments of this disclosure.

FIG. 6 illustrates an exemplary electrical system in accordance with some embodiments of this disclosure. As illustrated, electrical system 600 may include, among other components, a power plug 610, an electrical power outlet strip 620, and electrical appliance 130.

Power plug 610 may be similar to power plug 110 (discussed above with reference to FIG. 1), except for certain components or features. Power plug 610 may transmit electrical power from electrical power outlet strip 620 to electrical appliance 630. Power plug 610 may include, among other components, a plug insert 611 and a connector 613.

In some embodiments, plug insert 611 may include, among other components, a plug body 615 and a handle 617. Plug body 615 may include one or more insulation layers and conducting strips. The conducting strips may be placed on an insulation layer. In some embodiments, the conducting strips may be sandwiched between two insulation layers. For example, plug body 615 may include two insulation layers.

In some embodiments, a conducting strip and a conducting contact point may be separate parts that are electrically connected to each other. In some embodiments, a conducting strip and a conducting contact point may be formed as an integral piece. In some embodiments, the insulation layer(s) may have one or more conducting holes on its surface. The conducting holes may be configured so that one or more conducting contact points may be exposed on the surface of the plug body. A conducting contact point may be electrically connected to a hot wire, neutral, or ground wire. In some embodiments, a conducting contact point may be retractable. A conducting contact point may be pushed inwards when a force is applied on it.

In some embodiments, the conducting contact points may be formed on the same surface of plug body 615. Alternatively, at least one of the conducting contact points may be on a different surface of plug body 615 than at least another conducting contact point. In some embodiments, at least one of the conducting contact points may be formed on the bottom surface of plug body 615.

In some embodiments, one end of a conducting strip may include or be electrically connected to the conducting contact point. The other end of the conducting strip may be electrically connected to handle 617. A conducting contact point and a conducting strip may be separated parts electrically connected to each other, or formed as an integral piece.

In some embodiments, plug body 615 may include at least two conducting strips. A first conducting strip may be electrically connected to a hot wire through a first conducting contact point. A second conducting strip may be electrically connected to a neutral wire through a second conducting contact point. In some embodiments, the plug body may include three conducting strips. The first conducting strip may be electrically connected to a hot wire through a first conducting contact point. The second conducting strip may be electrically connected to a neutral wire through a second conducting contact point. The third conducting strip may be electrically connected to a ground wire through a third conducting contact point.

In some embodiments, one or more insulation layers may be manufactured using any suitable material including, for example, plastic, fiber, any other non-conductive material, or the like, or any combination thereof. In some embodiments, the conducting strips may be manufactured using any suitable material including, for example, such as metal (e.g., copper, aluminum, gold, etc.), an alloy, any other conductive material, or the like, or any combination thereof. In some embodiments, a conducting contact point may be manufactured using any suitable material including, for example, metal (e.g., copper, aluminum, gold, etc.), an alloy, any other conductive material, or the like, or any combination thereof. In some embodiments, a conducting strip and a conducting contact point may be made of a same material or different materials.

In some embodiments, connector 613 may be electrically connected to handle 617 of plug insert 611 to establish an electrical connection between handle 617 and plug insert 611. Connector 613 may be electrically connected to electrical appliance 630. In some embodiments, connector 613 may establish an electrical connection between electrical appliance 630 and plug body 615. The connection method for connecting connector 613 to handle 617 may include, for example, screwing, a rotary joint, or the like, or a combination thereof. In some embodiments, plug body 615 and handle 617 may be formed as an integral part. Plug body 615 may be retractable. In some embodiments, plug body 615 may be removed from handle 617. In some embodiments, handle 617 may be manufactured using any suitable material including, for example, plastic, fiber, any another non-conductive material, or the like, or any combination thereof.

In some embodiments, plug body 615 may be retractable. Plug body 615 may have two configurations, an extended configuration in which plug body 615 extends out of handle 617, and a retracted configuration in which plug body 615 is partially or entirely retracted into handle 617. In some embodiments, plug body 615 may be removable attached to handle 617. For instance, plug body 615 may be removed from handle 617 for, for example, storage or transportation, and plug body 615 may be attached to handle 617 for, for example, use.

In some embodiments, connector 613 may include one or more power port(s) 619. In some embodiments, power port 619 may be an electrical connection port which may include, for example, a columnar hole, a USB hole, a connection port connecting to a conducting wire, or the like, or a combination thereof.

In some embodiments, electrical power outlet strip 620 may include one or more conductors to transmit electrical power from the power source (e.g. a DC power source, an AC-to-DC power source, an AC power source) to electrical appliance 630 via power plug 610. The conductors may refer to a hot wire, a neutral wire and/or a ground wire. In some embodiments, the conductors may also include a data cable, a network cable, an audio/video cable, or the like, or a combination thereof.

In operation, plug body 615 may be inserted into electrical power outlet strip 620 through an opening. The conducting contact points in plug body 615 may be in contact with the electrical wires to establish an electrical connection between electrical power outlet strip 620 and electrical appliance 630. As a result, power port 619 may be electrically connected to the conductors in electrical power outlet strip 620.

Electrical appliance 630 may be electrically connected to the power source when it is connected to power port 619. The Electrical appliance 630 may be a cellphone to be charged, a laptop, a TV, a refrigerator, an air conditioner, a microwave woven, etc. Electrical appliance 630 may be electrically connected to the power source via an extension strip that is electrically connected to power port(s) 619.

Figure 7A:
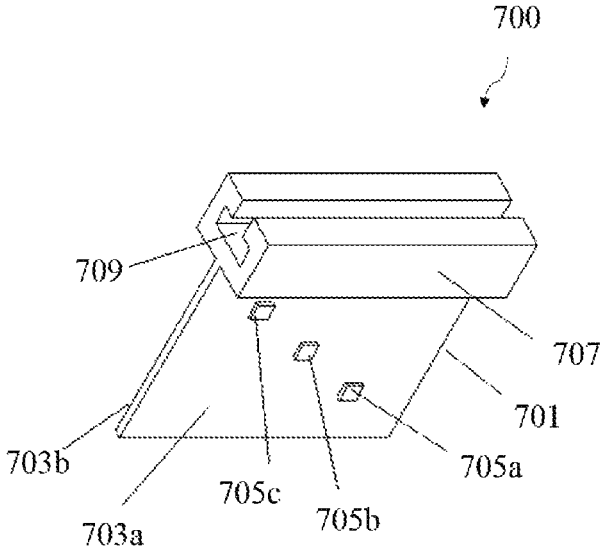
FIG. 7A illustrates the perspective view of an exemplary plug insert in accordance with some embodiments of this disclosure.

FIG. 7A illustrates the perspective view of an exemplary plug insert in accordance with some embodiments of this disclosure.

In some embodiments, plug insert 700 may include, among other components, a plug body 701 and a handle 707. Handle 707 may further include a wiring path 709.

In some embodiments, plug body 701 may be a piece that may be inserted into electrical power outlet strip 120. Plug body 701 may include one or more insulation layers (e.g. 703*a*, 703*b*, etc.) and one or more conducting strips (e.g. 711*a*, 711*b*, 711*c*, etc.). For example, plug body 701 may include two insulation layers 703*a* and 703*b* and three conducting strips 711*a*, 711*b*, and 711*c* sandwiched between insulation layers 703*a* and 703*b*. Insulation layer 703*b* may be referred to as a top insulation layer, and insulation layer 703*a* may be referred to as bottom insulation layer. Conducting strips 711*a*, 711*b*, and 711*c* may include a hot wire conducting strip, a neutral wire conducting strip, and a ground wire conducting strip.

Conducting strips 711*a*, 711*b*, and 711*c* may be arranged in an arbitrary order. In some embodiments, conducting strip 711*a* may be electrically connected to the hot wire conducting strip, conducting strip 711*b* may be electrically connected to the neutral wire conducting strip, and conducting strip 711*c* may be electrically connected to the ground wire conducting strip. In some embodiments, conducting strip 711*a* may be electrically connected to the neutral wire conducting strip, conducting strip 711*b* may be electrically connected to the ground wire conducting strip, and conducting strip 711*c* may be electrically connected to the hot wire conducting strip.

In some embodiments, the shape of a conducting strip (e.g., 711*a*, 711*b*, 711*c*, etc.) may include, for example, cuboid, cylinder, ellipsoid, or the like, or any combination thereof. The shapes of conducting strips may be the same as or different from each other.

In some embodiments, a conducting strip (e.g., 711*a*, 711*b*, 711*c*, etc.) may be manufactured using any suitable material including, for example, metal (e.g., copper, aluminum, gold, etc.), an alloy, and other conductive material, or the like, or any combination thereof. In some embodiments, a conducting strip (e.g., 711*a*, 711*b*, 711*c*, etc.) may be made of the same material as each other. In some embodiments, conducting strips (e.g., 711*a*, 711*b*, 711*c*, etc.) may be made of different materials.

The cross sectional area of a conducting strip (e.g., 711*a*, 711*b*, 711*c*, etc.) may vary between 0.1 $mm^2$ to 100.0 $mm^2$. In some embodiments, the cross sectional area of a conducting strip (e.g., 711*a*, 711*b*, 711*c*, etc.) may be 0.1 $mm^2$~1.0 $mm^2$, 1.0 $mm^2$2.0 $mm^2$, 2.1 $mm^2$3.0 $mm^2$, 3.0 $mm^2$4.0 $mm^2$, 4.0 $mm^2$~5.0 $mm^2$, 5.0 $mm^2$~6.0 $mm^2$, 6.0 $mm^2$~7.0 $mm^2$, 7.0 $mm^2$~8.0 $mm^2$, 8.0 $mm^2$~9.0 $mm^2$, 9.0 $mm^2$~10.0 $mm^2$, 10.0 $mm^2$~20.0 $mm^2$, 20.0 $mm^2$~30.0 $mm^2$, 30.0 $mm^2$~40.0 $mm^2$, 40.0 $mm^2$~50.0 $mm^2$, 50.0 $mm^2$~60.0 $mm^2$, 60.0 $mm^2$~70.0 $mm^2$, 70.0 $mm^2$~80.0 $mm^2$, 80.0 $mm^2$~90.0 $mm^2$, or 90.0 $mm^2$~100.0 $mm^2$. Merely by way of example, the cross sectional area of a conducting strip (e.g., 711*a*, 711*b*, 711*c*, etc.) may be approximately from 2 $mm^2$ to 3 $mm^2$. The cross sectional areas of different conducting strips (e.g., 711*a*, 711*b*, 711*c*, etc.) may be the same as or different from each other.

The shape of an insulation layer (e.g., 703*a*, 703*b*, etc.) may include, for example, cuboid, cylinder, ellipsoid, or the like, or any combination thereof. The shape of different insulation layers may be the same as or different from each other.

An insulation layer (e.g., 703*a*, 703*b*, etc.) may be manufactured using any suitable material including, for example, fiber, PVC, PC, PA66, or a mixture of PA66 and 30% glass fiber, any other non-conducting material, or the like, or any combination thereof. In some embodiments, different insulation layers (e.g., 703*a*, 703*b*, etc.) may be made of the same material as each other. In some embodiments, different insulation layers (e.g., 703*a*, 703*b*, etc.) may be made of different materials.

The shape of plug body 701 may include, for example, cuboid, cylinder, ellipsoid, or the like, or any combination thereof. The process of manufacturing plug body 701 may include, for example, laser cutting, integral forming, gluing, or the like, or any combination thereof.

In some embodiments, a conducting strip (e.g., 711*a*, 711*b*, 711*c*, etc.) may include or be electrically connected to a conducting contact point (e.g., 705*a*, 705*b*, 705*c*, etc.). A conducting contact point (e.g., 705*a*, 705*b*, 705*c*, etc.) may be electrically connected to a hot wire, a neutral wire, or a ground wire. In some embodiments, a conducting contact point (e.g., 705*a*, 705*b*, 705*c* etc.) may be retractable. A conducting contact point (e.g., 705*a*, 705*b*, 705*c*, etc.) may be pushed inwards when a force is applied on it.

In some embodiments, plug body 701 may have a first conducting strip electrically connected to a hot wire through a first conducting contact point, and a second conducting strip electrically connected to a neutral wire through a second conducting contact point. In some embodiments, plug body 701 may further include a third conducting strip electrically connected to a ground wire through a third conducting contact point.

In some embodiments, conducting contact points 705*a*, 705*b*, and 705*c* may be arranged in any configuration on the surface of plug body 701.

For example, they may be arranged horizontally. As a different example, they may be arranged vertically.

In some embodiments, a conducting contact point (e.g., 705*a*, 705*b*, 705*c*, etc.) may be manufactured using any suitable material including, for example, metal (e.g., copper, aluminum, gold, etc.), an alloy, and other conductive material, or the like, or any combination thereof. Conducting contact points 705*a*, 705*b* and 705*c* may or may not be made of a same material as each other.

Figure 20A:
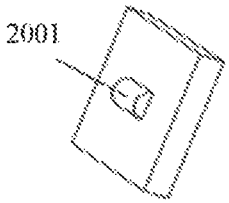
FIG. 20A and FIG. 20B respectively illustrate two exemplary conducting contact points in accordance with some embodiments of this disclosure.
Figure 20B:
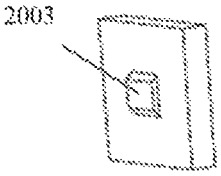

The surfaces of a conducting contact point (e.g., 705*a*, 705*b*, 705*c* etc.) may be formed in any shape (e.g., a curved surface, a plane surface, or a stepped surface). In some embodiments, a conducting contact point (e.g., 705*a*, 705*b*, 705*c*, etc.) may have a curved surface as shown in FIG. 20A. A conductor in electrical power outlet strip 620 may be configured to form an electrical contact with the conducting contact point. In some embodiments, a conducting contact point (e.g., 705*a*, 705*b*, 705*c*, etc.) may have a stepped surface as shown in FIG. 20B. The shape of a corresponding conductor in electrical power outlet strip 620 may be a cylinder.

Conducting contact points (e.g., 705*a*, 705*b*, 705*c*, etc.) may have a same type of surfaces or different types of surfaces. In some embodiments, conducting contact points 705*a* and 705*b* may have a stepped type surface, and conducting contact point 705*c* may have a curved type surface. In some embodiments, conducting contact points 705*a* and 705*b* may have a curved type surface, and conducting contact point 705*c* may have a stepped type surface.

The cross sectional area of a conducting strip (e.g., 711*a*, 711*b*, 711*c*, etc.) may vary between 0.1 $mm^2$ to 100.0 $mm^2$. In some embodiments, the cross sectional area of a conducting strip (e.g., 711*a*, 711*b*, 711*c*, etc.) may be 0.1 $mm^2$~1.0 $mm^2$, 1.0 $mm^2$~2.0 $mm^2$, 2.1 $mm^2$~3.0 $mm^2$, 3.0 $mm^2$~4.0 $mm^2$, 4.0 $mm^2$~5.0 $mm^2$, 5.0 $mm^2$~6.0 $mm^2$, 6.0 $mm^2$~7.0 $mm^2$, 7.0 $mm^2$~8.0 $mm^2$, 8.0 $mm^2$~9.0 $mm^2$, 9.0 $mm^2$~10.0 $mm^2$, 10.0 $mm^2$~20.0 $mm^2$, 20.0 $mm^2$~30.0 $mm^2$, 30.0 $mm^2$~40.0 $mm^2$, 40.0 $mm^2$~50.0 $mm^2$, 50.0 $mm^2$~60.0 $mm^2$, 60.0 $mm^2$~70.0 $mm^2$, 70.0 $mm^2$~80.0 $mm^2$, 80.0 $mm^2$~90.0 $mm^2$, or 90.0 $mm^2$~100.0 $mm^2$. Merely by way of example, the cross sectional area of a conducting strip may be approximately from 2 $mm^2$ to 3 $mm^2$. The cross sectional areas of different conducting strips may be the same as or different from each other.

In some embodiments, the other end of a conducting strip (e.g., 711*a*, 711*b*, 711*c*, etc.) may extend into wiring path 709 of handle 707 to be electrically connected to power line. As illustrated, wiring path 709 may be a channel. At least a portion of the channel may have a cross-section having a shape of a bulge including, for example, an inverted "T," a cross, etc.

Merely by way of example, when a connector 800 as described in FIG. 8A below is inserted into wiring path 709, a connector component 801 of connector 800 may be placed in the bulging or expanded portion of wiring path 709 such that connector 800 is secured in the wiring path 709.

Connector 800 may be removed from wiring path 709 from an end of wiring path 709, or from a location of wiring path 709 where the cross-section of wiring path 709 has a shape different from the shape of, for example, an inverted "T" or a cross. In some embodiments, the shape of handle 707 and wiring path 709 may include, for example, cuboid, cylinder, ellipsoid, the like, or any combination thereof.

In some embodiments, plug body 701 may have one or more insulation layers 703*a* and 703*b* and conducting strips 711*a*, 711*b* and 711*c* placed inside the insulation layer. In some embodiments, plug body 701 and handle 707 may be formed as an integral part. In some embodiments, plug body 701 may be retractable. Plug body 701 may have two configurations, an extended configuration in which plug body 701 extends out of handle 707, and a retracted configuration in which plug body 701 is partially or entirely retracted into handle 201. In some embodiments, plug body 701 may be removable attached to handle 707. For instance, plug body 701 may be removed from handle 707 for, for example, storage or transportation, and plug body 701 may be attached to handle 707 for, for example, use.

In some embodiments, plug insert 700 may further include a protective sleeve covering the plug insert 700. The sleeve may protect plug insert 700 from, for example, being bended, twisted, or broken. Plug body 701 may be inserted into electrical power outlet strip 620 that may include one or more conductors. The one or more conductors may be electrically connected to a hot wire, a neutral wire, and/or a ground wire. In some embodiments, the conductors may also include a data cable, a network cable, an audio/video cable, or the like, or a combination thereof.

The conductors may be manufactured using any suitable material including, for example, metal (e.g., copper, aluminum, gold, etc.), an alloy, and any other conductive material, the like, or any combination thereof. The conductors may or may not be made of a same material as each other.

When plug body 701 is inserted into power outlet strip 620, conducting contact points 705*a*, 705*b* and 705*c* in plug body 701 may be in contact with the conductors of electrical power outlet strip to establish an electrical connection between electrical power outlet strip 620 and plug insert 700.

The structures and functions described above in relation to the plug insert 700 are not exhaustive and are not limiting; numerous other changes, substitutions, variations, alterations, and modifications may be ascertained to one skilled in the art and it is intended that the present disclosure encompasses all such changes, substitutions, variations, alterations, and modifications as falling within the scope of the appended claims.

Figure 7B:
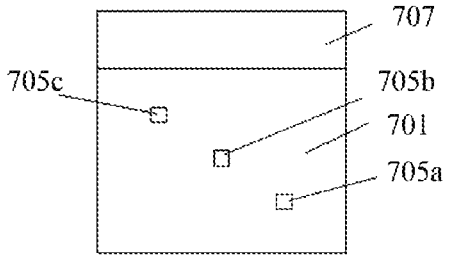
FIG. 7B illustrates the front view of an exemplary plug insert in accordance with some embodiments of this disclosure.
Figure 7C:
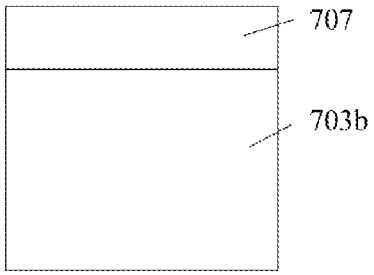
FIG. 7C illustrates the rear view of an exemplary plug insert in accordance with some embodiments of this disclosure.
Figure 7D:
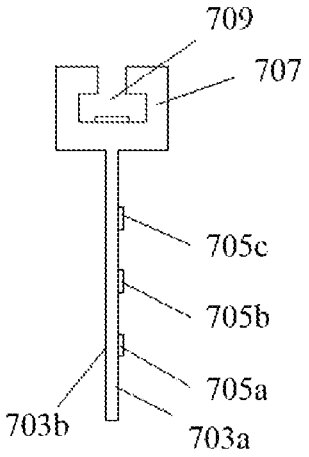
FIG. 7D illustrates the left view of an exemplary plug insert in accordance with some embodiments of this disclosure.
Figure 7E:
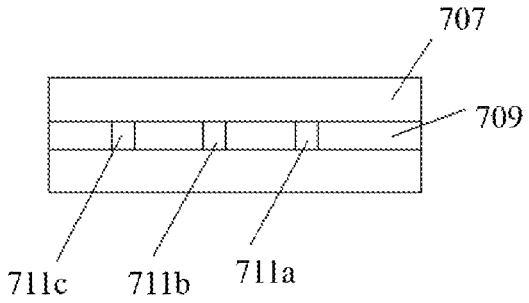
FIG. 7E illustrates the top view of an exemplary plug insert in accordance with some embodiments of this disclosure.

FIG. 7B illustrates the front view of an exemplary plug insert in accordance with some embodiments of this disclosure. FIG. 7C illustrates the rear view of an exemplary plug insert in accordance with some embodiments of this disclosure. FIG. 7D illustrates the left view of an exemplary plug insert in accordance with some embodiments of this disclosure. FIG. 7E illustrates the top view of an exemplary plug insert in accordance with some embodiments of this disclosure. The plug insert in FIG. 7B, FIG. 7C, FIG. 7D, and FIG. 7E may be the same plug insert 700 as described in FIG. 7A.

Figure 8A:
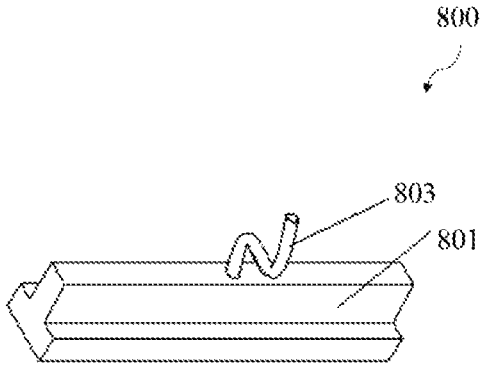
FIG. 8A illustrates the perspective view of an exemplary connector in accordance with some embodiments of this disclosure.
Figure 8B:
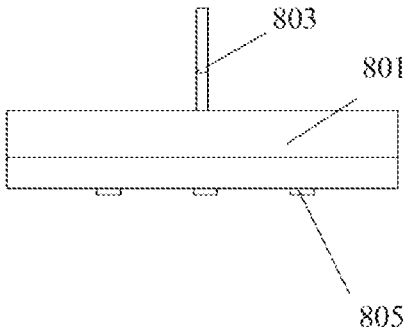
FIG. 8B illustrates the front view of an exemplary connector in accordance with some embodiments of this disclosure.

FIG. 8A and FIG. 8B respectively illustrate the perspective view and the front view of an exemplary connector in accordance with some embodiments of this disclosure. Connector 800 is configured to match the size and shape of wiring path 709 in plug insert 700.

In some embodiments, connector 800 may include, among other components, a connector component 801, one or more electrical connecting strips 805 and a power line 803.

In some embodiments, connector 800 may include at least two electrical connecting strips 805 configured inside the connector component 801. The number of electrical connecting strips 805 may equal to the number of conducting strips (e.g., 711*a*, 711*b*, 711*c*, etc.) in plug body 701.

Electrical connecting strips 805 may have an end configured to match the positions of conducting strips (shown in FIG. 7E as 711*a*, 711*b* and 711*c*) in the wiring path 709. When connector component 801 is inserted into wiring path 709, connector 800 is electrically connected to plug insert 700.

Connector 801 may be also electrically connected to electrical appliance 630.

The other ends of conducting strips may be electrically connected to power line 803. Power line 803 may be electrically connected to a plug, or any electrical appliance 630, such as a cellphone, a TV, a laptop, a refrigerator, an air conditioner, a microwave oven, or the like, or any combination thereof.

Power line 803 may be made of coated leather and core. The core may be connected to electrical connecting strips 805. Connector component 801 may be manufactured using any suitable material including, for example, plastic, fiber, any other non-conductive material, or the like, or any combination thereof.

The structures and functions described above in relation to the connector 800 are not exhaustive and are not limiting; numerous other changes, substitutions, variations, alterations, and modifications may be ascertained to one skilled in the art and it is intended that the present disclosure encompasses all such changes, substitutions, variations, alterations, and modifications as falling within the scope of the appended claims.

Figure 8C:
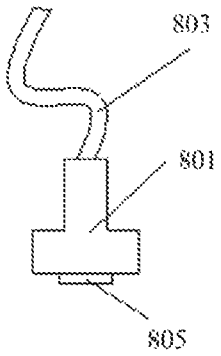
FIG. 8C illustrates the left view of an exemplary plug insert in accordance with some embodiments of this disclosure.
Figure 8D:
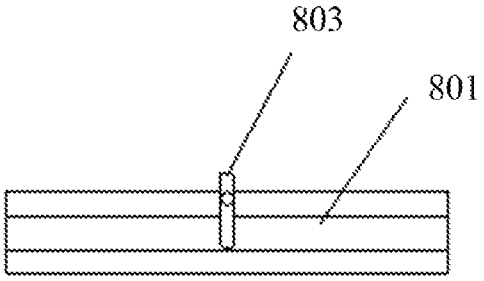
FIG. 8D illustrates the top view of an exemplary plug insert in accordance with some embodiments of this disclosure.

FIG. 8C illustrates the left view of the exemplary connector 800 in accordance with some embodiments of this disclosure. FIG. 8D illustrates the top view of the exemplary connector 800 in accordance with some embodiments of this disclosure.

Figure 9A:
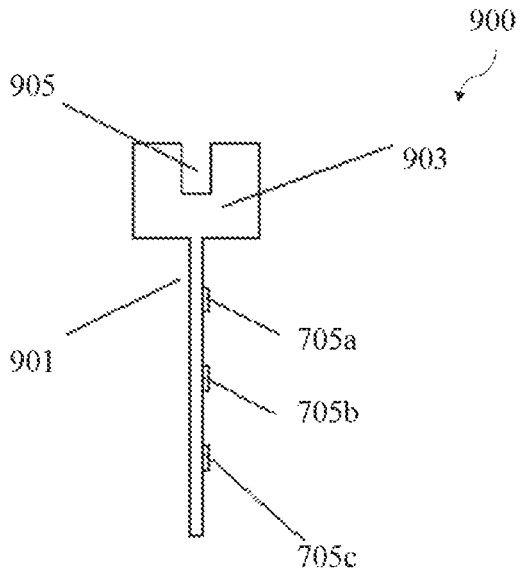
FIGS. 9A and 9B respectively illustrate the left view and the top view of an exemplary plug insert in accordance with some embodiments of this disclosure.
Figure 9B:
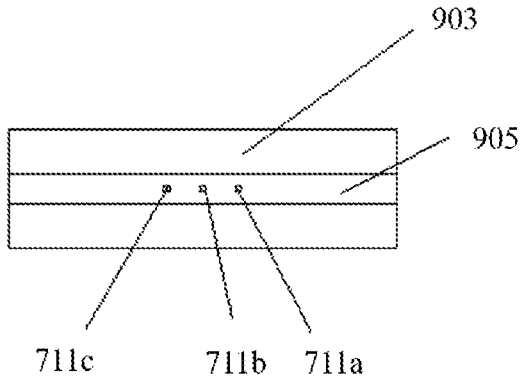

FIG. 9A and FIG. 9B respectively illustrate the left view and the top view of an exemplary plug insert in accordance with some embodiments of this disclosure. As shown, plug insert 900 is similar to plug insert 700 (discussed above with reference to FIG. 7), except that the wiring path 905 is configured in a rectangular strip.

Figure 10A:
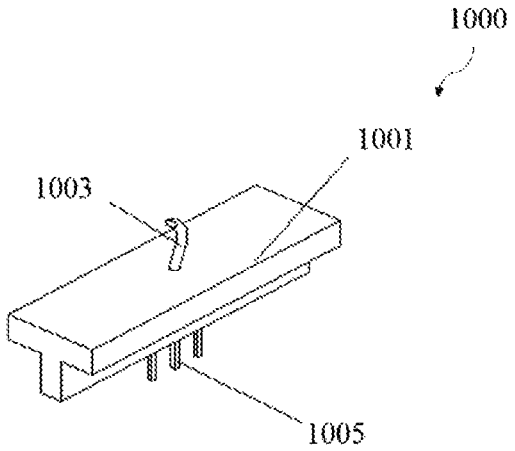
FIG. 10A and FIG. 10B respectively illustrate the perspective view and the front view of an exemplary connector in accordance with some embodiments of this disclosure.
Figure 10B:
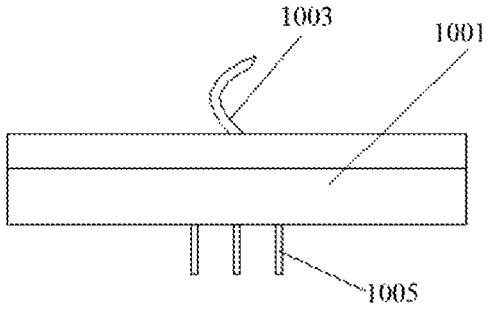

FIG. 10A and FIG. 10B respectively illustrate the perspective view and the front view of an exemplary connector in accordance with some embodiments of this disclosure. As shown, connector 1000 is similar to connector 800 (discussed above with reference to FIG. 8), except that connector 1000 is configured to match the size and shape of wiring path 905 in plug insert 900. When connector component 1001 is inserted into wiring path 905, connector 1000 may be electrically connected to plug insert 900.

Figure 11A:
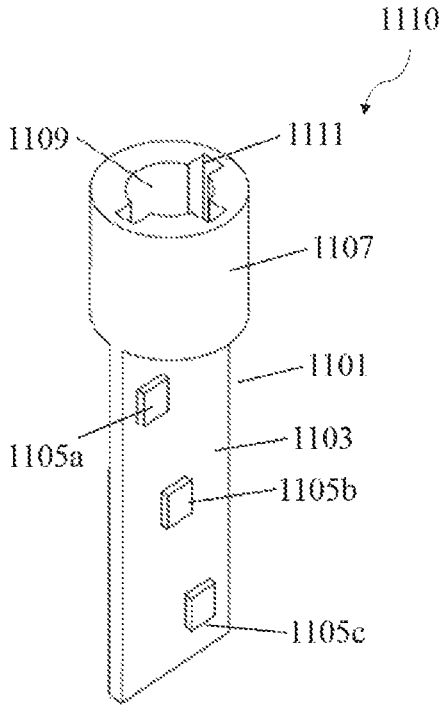
FIG. 11A illustrates the perspective view of an exemplary plug insert in accordance with some embodiments of this disclosure.

FIG. 11A illustrates the perspective view of an exemplary plug insert in accordance with some embodiments of this disclosure. In some embodiments, plug insert 1110 may include, among other components, a plug body 1101 and a handle 1107. Handle 1107 may further include an insertion opening 1109. In some embodiments, the shape of insertion opening 1109 may include, for example, cuboid, cylinder, ellipsoid, or the like, or any combination thereof. The process of manufacturing plug body 1101 may include, for example, laser cutting, integral forming, chiseling, or the like, or any combination thereof.

In some embodiments, plug body 1101 and handle 1107 may be formed as an integral part. Plug body 1101 may be retractable. In some embodiments, plug body 1101 may be removed from handle 1107. In some embodiments, one or more insertion grooves 1111 may be formed on the inner surface of insertion opening 1109. For example, three insertion grooves 1111 may be formed on the inner surface of insertion opening 1109. In some embodiments, insertion grooves 1111 may be essentially vertical. Insertion groove 1111 may be accommodate a connector as described in FIG. 12 that may insert. The shape of insertion groove 1111 may include, for example, cuboid, cylinder, ellipsoid, the like, or any combination thereof. The process of manufacturing the insertion groove 1111 may include, for example, laser cutting, integral forming, chiseling, or the like, or any combination thereof.

In some embodiments, plug body 1101 may be retractable. Plug body 1101 may have two configurations, an extended configuration in which plug body 1101 extends out of handle 1107, and a retracted configuration in which plug body 1101 is partially or entirely retracted into handle 1107. In some embodiments, plug body 1101 may be removable attached to handle 1107. For instance, plug body 1101 may be removed from handle 1107 for, for example, storage or transportation, and plug body 1101 may be attached to handle 1107 for, for example, use.

In some embodiments, plug body 1101 may include one or more insulation layers 1103. For example, plug body 1101 may include two insulation layers 1103. Plug body 1101 may include one or more conducting strips, as described in conjunction with FIG. 7. The one or more conducting strips may be placed on an insulation layer 1103. In some embodiments, the conducting contact points may be sandwiched between two insulation layers.

The number of conducting contact points (e.g. 1105*a*, 1105*b* and 1105*c*) may be at least two and variable. In some embodiments, conducting contact points 1105*a*, 1105*b* and 1105*c* are on the same surface of plug body 1101. For example, plug body 1101 may include at least two conducting contact points (e.g., two of 1105*a*, 1105*b* and 1105*c*) and the at least two of the conducting contact points of may be placed on a same surface of plug body 1101. Alternatively, at least one of the conducting contact points may be on a different surface of plug body 1101 than at least another conducting contact point. In some embodiments, at least one of conducting contact points of 1105*a*, 1105*b* and 1105*c* may be placed on the bottom surface of plug body 1101.

In some embodiments, when plug body 1101 includes two conducting contact points (e.g., two of 1105*a*, 1105*b* and 1105*c*), a first conducting contact point may be electrically connected to a hot wire, and a second conducting contact point may be electrically connected to a neutral wire.

In some embodiments, when plug body 1101 may include three conducting contact points 1105*a*, 1105*b* and 1105*c*, the three conducting contact points 1105*a*, 1105*b* and 1105*c* may be electrically connected to a hot wire, a neutral wire, and a ground wire, respectively. The hot wire conducting contact point may be the closest to the insertion end of plug body 1101. The insertion end is the first part in plug body 1105*a*, 1105*b* and 1105*c* to insert into electrical power outlet strip 620. In some embodiments, the distances between different conducting contact points (e.g. 1105*a*, 1105*b* and 1105*c*) and the insertion end may be the same. As illustrated in FIG. 11A, the distances between different conducting contact points (e.g. 1105*a*, 1105*b* and 1105*c*) and the insertion end may be different. In some embodiments, plug body 1101 may include additional conducting contact points that may be electrically connected to a data cable, a network cable, an audio/video cable, or the like, or a combination thereof.

Figure 11B:
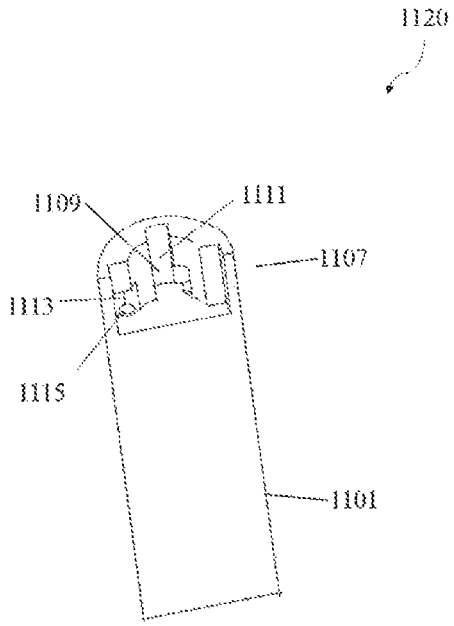
FIG. 11B illustrates the cross-sectional view of an exemplary plug insert in accordance with some embodiments of this disclosure.

FIG. 11B illustrates the cross-sectional view of an exemplary plug insert in accordance with some embodiments of this disclosure. As shown, plug insert 1120 may include a plug body 1101 and a handle 1107.

In some embodiments, one or more concave slots 1113 may be formed at the bottom of the insertion groove 1111. Concave slots 1113 may include one or more inner contact points 1115 formed on the bottom surface of concave slots 1113. Inner contact points 1115 may be electrically connected to or formed as an integral piece with one or more conducting strips in plug body 1101. An inner contact point 1115 may be retractable. Inner contact point 1115 may be pushed inwards when a force is applied on it.

Figure 12:
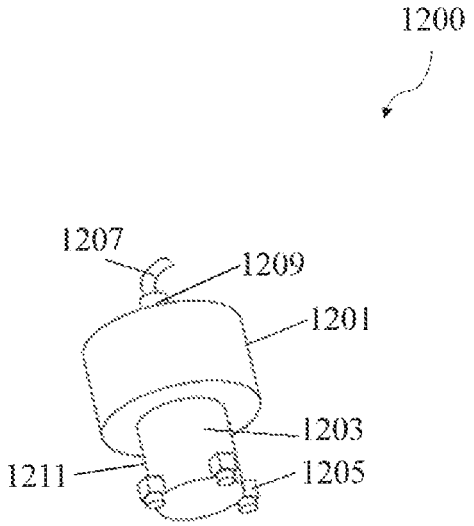
FIG. 12 illustrates the perspective view of an exemplary connector in accordance with some embodiments of this disclosure.

In some embodiments, inner contact point 1115 may establish an electrical connection between plug insert 1120 and connector 1200 (described in conjunction with FIG. 12). In some embodiments, concave slots 1113 may be configured to accommodate insertion grooves 1111. Concave slots 1113 may be placed clockwise or anticlockwise around the bottom of insertion opening 1109. The positions of insertion groove 1111 and inner contact points 1115 may be separated by a certain angle. The process of manufacturing concave slots 1113 and contact points 1115 may include, for example, laser cutting, integral forming, chiseling, or the like, or any combination thereof.

FIG. 12 illustrates the perspective view of an exemplary connector in accordance with some embodiments of this disclosure. As shown, connector 1200 may include, among other components, a connector component 1201, a power port 1209, and an insertion column 1203.

In some embodiments, power port 1209 may be a charging port that may be a USB port, a hole, or the like. Power port 1209 may be electrically connected to a power line 1207 of electrical appliance 630 such that electrical power may be transmitted from the power source to electrical appliance 630.

Connector component 1201 may be manufactured using any suitable material, such as plastic, fiber, any other non-conductive material, or the like, or any combination thereof.

In some embodiments, insertion column 1203 may be formed on the bottom surface of connector component 1201. The process of manufacturing insertion column 1203 and connector component 1201 may include, for example, integral forming, mechanical installing, or the like. One or more outer contact points 1205 may be on the bottom of surface 1211 of insertion column 1203. Insertion column 1203 may be manufactured using any suitable material including, for example, plastic, fiber, any other non-conductive material, or the like, or any combination thereof.

In some embodiments, connector 1200 may include one or more electrical connecting strips. One end of the electrical connecting strip may form or be electrically connected to outer contact points 1205. For example, three outer contact points 1205 may be formed on surface 1211 of insertion column 1203. In some embodiments, the number of outer contact points 1205 may match that of insertion grooves 1111. An electrical connecting strip and an outer contact point 1205 may be separated parts electrically connected to each other, or formed as an integral piece.

Figure 13A:
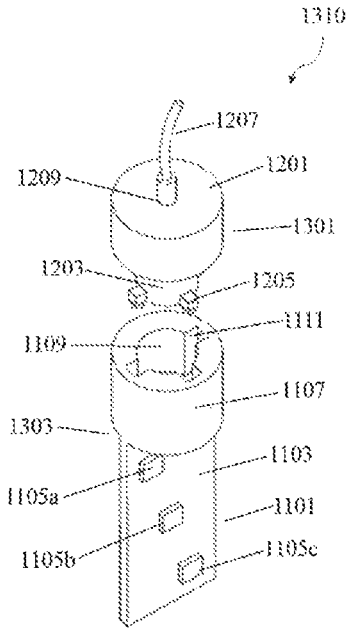
FIG. 13A illustrates the perspective view of an exemplary power plug in accordance with some embodiments of this disclosure.

FIG. 13A illustrates the perspective view of an exemplary power plug in accordance with some embodiments of this disclosure. As shown, power plug 1310 may include, among other components, a connector 1301 and a plug insert 1303. In some embodiments, plug insert 1303 may be as descried in conjunction with FIG. 11A and FIG. 11B above. Connector 1301 may be as descried in conjunction with FIG. 12 above.

Figure 13B:
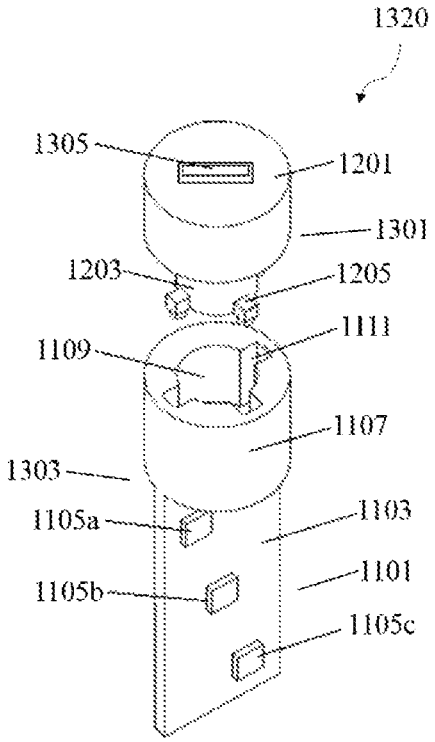
FIG. 13B illustrates the perspective view of an exemplary power plug in accordance with some embodiments of this disclosure.

FIG. 13B illustrates the perspective view of an exemplary power plug in accordance with some embodiments of this disclosure. As shown, power plug 1320 may include, among other components, a connector 1301 and a plug insert 1303. As shown, power plug 1320 is similar to power plug 1310 (discussed above with reference to FIG. 13A), except for certain components or features.

For example, power port 1305 in power plug 1320 may be a USB port used for charging and/or connecting to electrical appliance 630. In some embodiments, related information of plug insert 1303 may be as descried in conjunction with FIG. 11A and FIG. 11B above. Related information of connector 1301 may be as descried in conjunction with FIG. 12 above.

Figure 14A:
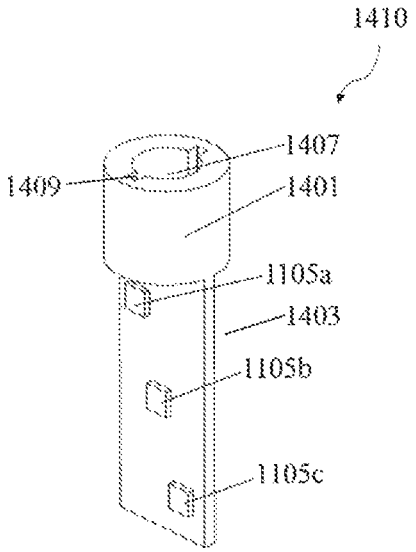
FIG. 14A and FIG. 14B respectively illustrate the perspective view and the top view of an exemplary plug insert in accordance with some embodiments of this disclosure.
Figure 14B:
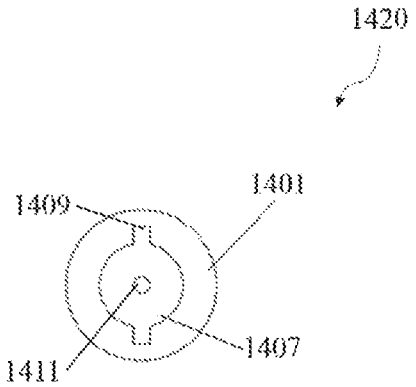

FIG. 14A and FIG. 14B respectively illustrate the perspective view and the top view of an exemplary plug insert in accordance with some embodiments of this disclosure. Plug insert 1410 and 1420 may include, among other components, a handle 1401 and a plug body 1403. As shown, plug insert 1410 and 1420 are similar to plug insert 1110 (discussed above with reference to FIG. 11A), except that certain features are modified or added.

For example, handle 1401 may include one or more insertion openings 1407. In the top view in FIG. 14B, a conducting strip may form or be electrically connected to one or more inner contact points 1411 on the bottom surface of insertion opening 1407. For example, an inner contact point 1411 may be formed on the bottom surface of insertion opening 1407. Inner contact point 1411 may be retractable. Inner conducting contact point 1411 may be pushed inwards when a force is applied on it. A conducting strip and an inner contact point 1411 may be separated parts electrically connected to each other, or formed as an integral piece.

In some embodiments, handle 1401 may include two insertion grooves 1409. In some embodiments, insertion groove 1409 may be essentially vertical. Insertion groove 1409 may be a path into which a connector may insert. The shape of insertion groove 1409 may include, for example, cuboid, cylinder, ellipsoid, the like, or any combination thereof. The process of manufacturing insertion groove 1409 may include, for example, laser cutting, integral forming, chiseling, the like, or any combination thereof.

Figure 14C:
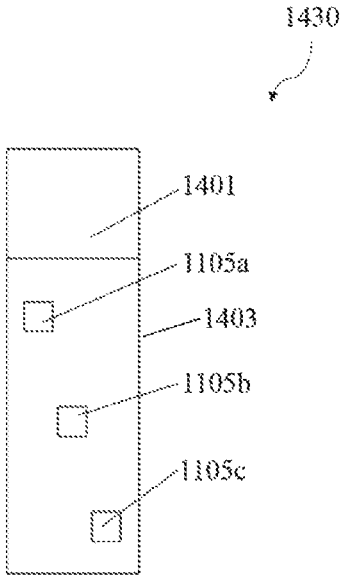
FIG. 14C illustrates the front view of an exemplary plug insert in accordance with some embodiments of this disclosure.

FIG. 14C illustrates the front view of an exemplary plug insert in accordance with some embodiments of this disclosure. The exemplary plug insert is the same plug insert as described in FIG. 14A and FIG. 14B.

Figure 15A:
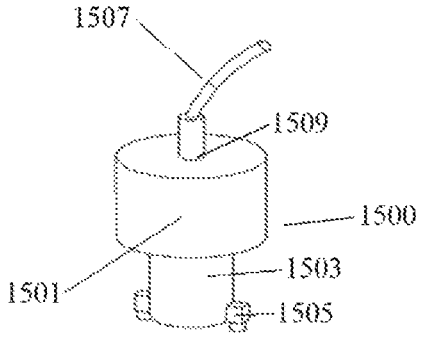
FIG. 15A and FIG. 15B respectively illustrate the perspective view and the bottom view of an exemplary connector in accordance with some embodiments of this disclosure.
Figure 15B:
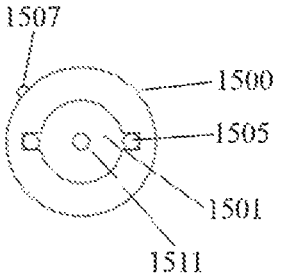

FIG. 15A and FIG. 15B respectively illustrate the perspective view and the bottom view of an exemplary connector in accordance with some embodiments of this disclosure. Connector 1500 may include, among other components, a connector component 1501, a power port 1509, an insertion column 1503 and one or more bulge(s) 1505. As shown, connector 1500 may be similar to connector 1200 (discussed above with reference to FIG. 12), except for certain components or features.

For example, in the bottom view FIG. 15B, one or more electrical connecting strips may be electrically connected to outer contact point 1511 on the bottom surface of insertion column 1501. Outer contact points 1511 may be retractable. Outer contact point 1511 may be pushed inwards when a force is applied on it. An electrical connecting strip and outer contact point 1511 may be separated parts electrically connected to each other, or formed as an integrated piece. The electrical connecting strips may be electrically connected to power port 1509 such that power line 1507 may transmit electrical power from the power source to electrical appliance 630.

In some embodiments, the number of electrical connecting strips may match the number of conducting strips in plug insert 1400. The number of bulges 1505 may match that of insertion grooves 1409 in FIG. 14A. For example, the number of bulges 1505 may be two.

In some embodiments, connector 1500 may be fixed to insertion opening 1407 of plug insert 1400 in FIG. 14A by a rotary joint. In a rotary joint, connector 1500 may be inserted into insertion opening 1407 and then rotated clockwise or anticlockwise to be secured in insertion opening 1407. As a result, outer contact point 1511 may be in contact with and electrically connected to inner contact point 1511.

Figure 15C:
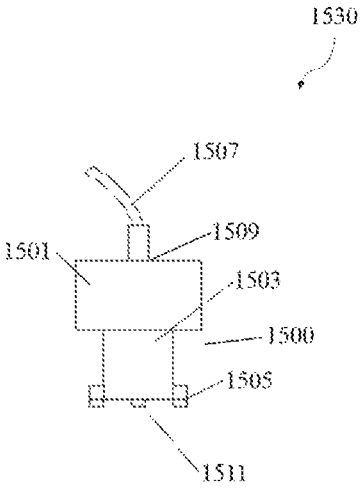
FIG. 15C illustrates the front view of an exemplary connector in accordance with some embodiments of this disclosure.

FIG. 15C illustrates the front view of an exemplary connector in accordance with some embodiments of this disclosure. The exemplary connector is the same connector as described in FIG. 15A and FIG. 15B.

Figure 16:
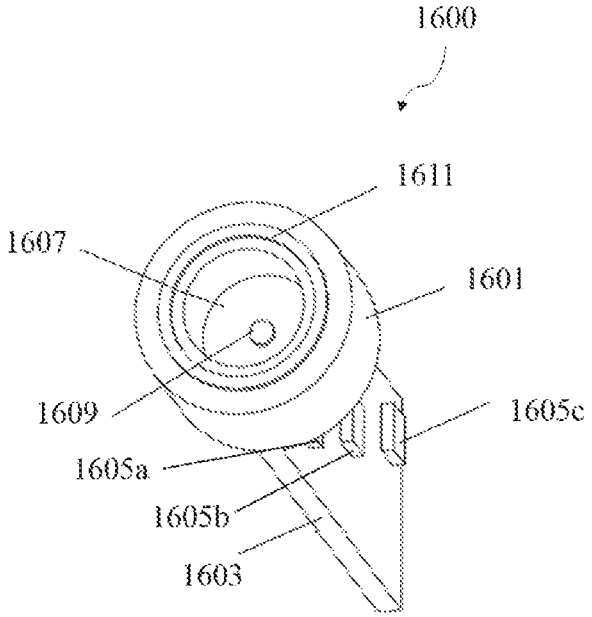
FIG. 16 illustrates the perspective view of an exemplary plug insert in accordance with some embodiments of this disclosure.

FIG. 16 illustrates the perspective view of an exemplary plug insert in accordance with some embodiments of this disclosure. As shown, plug insert 1600 is similar to plug insert 700 (discussed above with reference to FIG. 7), except for certain components or features.

In some embodiments, plug insert 1600 may include, among other components, a handle 1601 and a plug body 1603. Handle 1601 may further include an insertion opening 1607.

In some embodiments, one or more inner contact points 1609 may be formed on the bottom surface of insertion opening 1607. One or more inner contact circles 1611 may be formed at the upper edge of insertion opening 1607. One or more inner screw threads may be formed on the inner wall of the insertion opening 1607. In some embodiments, the shape of insertion opening 1607 may include, for example, cuboid, cylinder, ellipsoid, or the like, or any combination thereof.

All or part of the inner screw threads may be manufactured using any suitable material including, for example, metal (e.g., copper, aluminum, gold, etc.), alloy, and other conductive material, or the like, or any combination thereof.

In some embodiments, one or more conducting strips (not shown), as described in conjunction with FIG. 7, may be placed inside the plug body 1603. A conducting strip may form or be electrically connected to a conducting contact point.

A conducting contact point may be electrically connected to a hot wire, a neutral wire, or a ground wire. In some embodiments, a conducting contact point may be retractable. A conducting contact point may be pushed inwards when a force is applied on it. In some embodiments, the conducting contact points may be formed on the same surface of plug body 1603. Alternatively, at least one of the conducting contact points may be on a different surface of plug body 1603 than at least another the conducting contact points. In some embodiments, at least one of the conducting contact points may be on the bottom surface of the plug body 1603.

In some embodiments, plug body 1603 may have a first conducting strip electrically connected to a hot wire through a first conducting contact point, and a second conducting strip electrically connected to a neutral wire through a second conducting contact point. In some embodiments, plug body 1606 may further include a third conducting strip electrically connected to a ground wire through a third conducting contact point. A conducting contact point and a conducting strip may be separated parts electrically connected to each other, or formed as an integral piece.

Conducting contact points 1605*a*, 1605*b* and 1605*c* may be electrically connected to at least two of insertion opening 1607, inner contact point 1609, and inner contact circle 1611. For example, two conducting contact points 1605*a*, 1605*b* and 1605*c* may be formed on the surface of plug body 1603, and they may be electrically connected to insertion opening 1607 and inner contact points 1609, respectively. As a different example, three conducting contact points 1605*a*, 1605*b*, and 1605*c* may be formed on the surface of plug body 1603, and they may be electrically connected to insertion opening 1607, inner contact points 1609, and inner contact circle 1611, respectively.

Figure 17A:
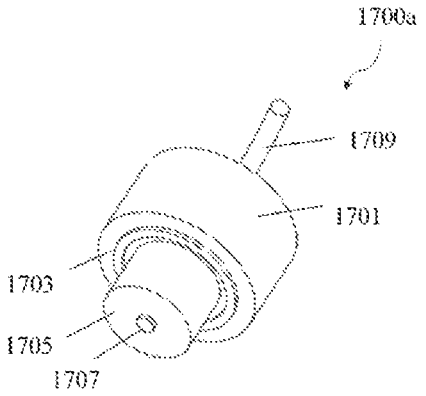
FIG. 17A illustrates the perspective view of an exemplary connector in accordance with some embodiments of this disclosure.

FIG. 17A illustrates the perspective view of an exemplary connector in accordance with some embodiments of this disclosure. Connector 1700*a* is configured to match the size and shape of plug insert 1600. As shown, connector 1700*a* is similar to connector 800 (discussed above with reference to FIG. 8), except for certain components or features.

In some embodiments, connector 1700*a* may include, among other components, a connector component 1701, an insertion column 1705 and a power line 1709.

Insertion column 1705 may be on the bottom surface of the connector component 1701. One or more outer contact points 1707 may be formed on the bottom surface of insertion column 1705. One or more outer contact circles 1703 may be formed at the upper edge of insertion column 1705.

Insertion column 1705, outer contact points 1707, and outer contact circles 1703 may be electrically connected to power line 1709.

Power line 1709 may be electrically connected to a plug, or any electrical appliance 630, such as a cellphone, a TV, a laptop, a refrigerator, an air conditioner, a microwave oven, or the like, or any combination thereof.

One or more outer screw threads may be formed on the outer wall of insertion column 1705. The outer screw threads may be manufactured using any suitable material including, for example, metal (e.g., copper, aluminum, gold, etc.), an alloy, and any other conductive material, the like, or any combination thereof.

Figure 17B:
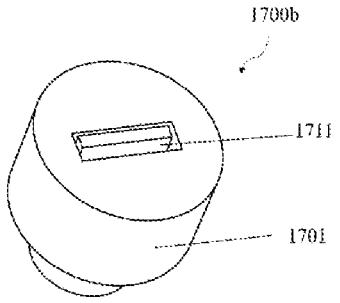
FIG. 17B illustrates the perspective view of an exemplary connector in accordance with some embodiments of this disclosure.

FIG. 17B illustrates the perspective view of an exemplary connector in accordance with some embodiments of this disclosure. Connector 1700*b* is configured to match the size and shape of plug insert 1600. As shown, connector 1700*b* is similar to connector 1700*a* (discussed above with reference to FIG. 17A), except that connector 1700*b* may further include one or more power port(s) 1711.

Power port 1711 may be electrically connected to the insertion column 1705, outer contact points 1707, and outer contact circles 1703. Power port 1711 may be configured in any proper shape and size. For example, power port 1711 may be a USB hole, as shown in FIG. 17B. As a different example, power port 1711 may be formed as a columnar hole (discussed above with reference to FIG. 3).

Figure 18:
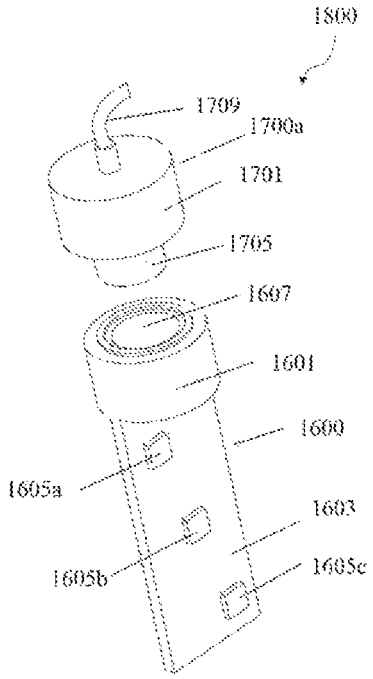
FIG. 18 illustrates the perspective views of an exemplary power plug in accordance with some embodiments of this disclosure.

FIG. 18 illustrates the perspective view of an exemplary power plug in accordance with some embodiments of this disclosure. Power plug 1800 may include, among any other component, a plug insert 1600 as described in conjunction with FIG. 16 and a connector 1700*a* as described in conjunction with FIG. 17A.

The outer screw threads on insertion column 1705 may be configured to match the inner screw threads on insertion opening 1607, so that insertion column 1705 and insertion opening 1607 may be electrically connected by the outer screw threads and the inner screw threads.

When insertion column 1705 is screwed into the insertion opening 1607, insertion column 1705 will be electrically connected to the insertion opening 1607, outer contact points 1707 may be electrically connected to the inner contact points 1609, and outer contact circles 1703 will be electrically connected to the inner contact circles 1611. It is understood that the connection by way of the outer screw threads on the outer wall of insertion column 1705 and the inner screw threads on the inner wall of insertion opening 1607 is provided for illustration purposes, and not intended to limit the scope of the present disclosure. Other ways may be used to establish the electrical connection between insertion column 1705 and insertion opening 1607.

Plug body 1603 may be inserted into an electrical power outlet strip that may include one or more conductors. The one or more conductors may be electrically connected to a hot wire, a neutral wire, and a ground wire, respectively. In some embodiments, the conductors may also include a data cable, a network cable, an audio/video cable, or the like, or a combination thereof.

The conductors may be manufactured using any suitable material including, for example, metal (e.g., copper, aluminum, gold, etc.), an alloy, and any other conductive material, or the like, or any combination thereof. The conductors may or may not be manufactured by a same material as each other.

When plug body 1603 is inserted into electrical power outlet strip 620, conducting contact points 1605*a*, 1605*b*, and 1605*c* in plug body 1603 may be in contact with the conductors of electrical power outlet strip 620 to establish an electrical connection between electrical power outlet strip 620 and power plug 1800.

As a result, power line 1709 may be electrically connected to electrical power outlet strip 620. Power line 1709 may also be to supply electricity to a plug, or any electrical appliance 630, such as a cellphone, a TV, a laptop, a refrigerator, an air conditioner, a microwave oven, or the like, or any combination thereof.

The structures and functions described above in relation to power plug 1800 are not exhaustive and are not limiting; numerous other changes, substitutions, variations, alterations, and modifications may be ascertained to one skilled in the art and it is intended that the present disclosure encompasses all such changes, substitutions, variations, alterations, and modifications as falling within the scope of the appended claims.

Figure 19A:
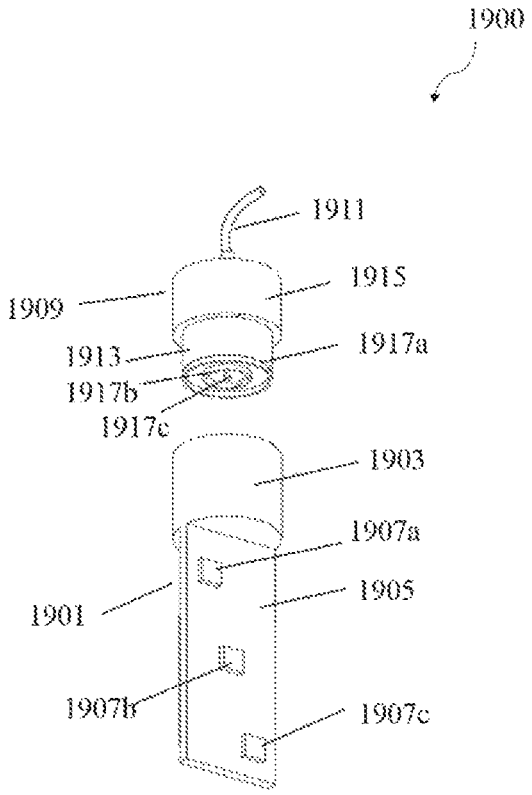
FIG. 19A and FIG. 19B respectively illustrate two perspective views of an exemplary power plug in accordance with some embodiments of this disclosure.
Figure 19B:
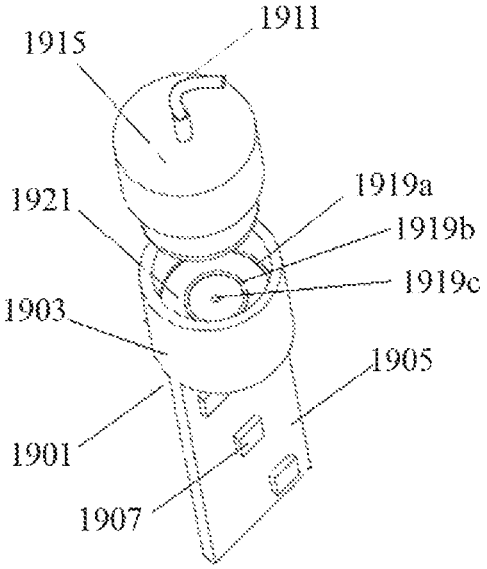

FIG. 19A and FIG. 19B respectively illustrate two perspective views of an exemplary power plug in accordance with some embodiments of this disclosure. As shown, power plug 1900 is similar to power plug 1800 (discussed above with reference to FIG. 18), except for certain components or features.

In some embodiments, power plug 1900 may include, among other components, a plug insert 1901 and a connector 1909.

Plug insert 1901 may include, among other components, a handle 1903 and a plug body 1905. Handle 1903 may further include an insertion opening 211921. In some embodiments, the shape of insertion opening 1921 may include, for example, cuboid, cylinder, ellipsoid, or the like, or any combination thereof.

One or more conducting strips (not shown) may be configured inside plug body 1905. A conducting strip may form or be electrically connected to one or more conducting contact points (e.g., 1907*a*, 1907*b*, 1907*c*, etc.) on the surface of plug body 1905.

In some embodiments, the conducting contact points 1907*a*, 1907*b*, and 1907*c* may be formed on the same surface of plug body 1905. Alternatively, at least one of the conducting contact points 1907*a*, 1907*b*, and 1907*c* may be on a different surface of plug body 1905 than at least one of the conducting contact points. In some embodiments, at least one of the conducting contact points 1907*a*, 1907*b* and 1907*c* may be on the bottom surface of the plug body 1905.

In some embodiments, plug body 1905 may have a first conducting strip electrically connected to a hot wire through a first conducting contact point, and a second conducting strip electrically connected to a neutral wire through a second conducting contact point. In some embodiments, plug body 1905 may further include a third conducting strip electrically connected to a ground wire through a third conducting contact point. A conducting contact point 1907*a*, 1907*b* or 1907*c* and a conducting strip may be separated parts electrically connected to each other, or formed as an integral piece.

The other end of each conducting strip may be electrically connected to one or more conducting rings in insertion opening 1921. One or more inner screw threads may be formed on the inner surface of insertion opening 1921.

Connector 1909 may include, among other components, a connector component 1915, an insertion column 1913 and a power line 1911. One or more electrical connecting strips may be placed inside connector 1909. Each electrical connecting strip may include one end electrically connected to one or more conducting rings 1917*a*, 1917*b*, and 1917*c*, and the other end electrically connected to power line 1911.

The number of the electrical connecting strips may be variable. The number of the electrical connecting strips may equal to the number of the conducting strips in plug body 1901. In some embodiments, the number of electrical connecting strips and the number of the conducting strips may both be two. The number of conducting contact points (e.g., 1907*a*, 1907*b*, etc.), the number of conducting rings (e.g., 1917*a*, 1917*b*, etc.) in connector 1909, and the number of conducting rings (e.g., 1919*a*, 1919*b*, etc. in plug insert 1901 may all be two. In some embodiments, the number of the electrical connecting strips and the number of the conducting strips may both be three. The number of conducting contact points (e.g., 1907*a*, 1907*b*, 1907*c* etc.), the number of conducting rings (e.g., 1917*a*, 1917*b*, 1917*c* etc.) in connector 1909, and the number of conducting rings (e.g., 1919*a*, 1919*b*, 1919*c*, etc.) in plug insert 1901 may all be three.

Conducting rings 1917*a*, 1917*b*, and 1917*c* in connector 1909 may be configured to match the position and size of conducting rings 1919*a*, 1919*b*, and 1919*c* in plug insert 1901.

One or more outer screw threads may be on the outer surface of the insertion column 1913. The outer screw threads on insertion column 1913 may be configured to match the inner screw threads on the insertion opening 1921, so that insertion column 1913 and insertion opening 1921 may be electrically connected by the outer screw threads and the inner screw threads.

When insertion column 1913 is screwed into the insertion opening 1607, insertion column 1913 may be electrically connected to insertion opening 1921, conducting rings 1917*a*, 1917*b*, and 1917*c* in connector 1909 may be electrically connected to the conducting rings 1919*a*, 1919*b*, and 1919*c* in plug insert 1901.

The structures and functions described above in relation to the power plug 1900 are not exhaustive and are not limiting; numerous other changes, substitutions, variations, alterations, and modifications may be ascertained to one skilled in the art and it is intended that the present disclosure encompasses all such changes, substitutions, variations, alterations, and modifications as falling within the scope of the appended claims.

FIG. 20A and FIG. 20B respectively illustrate exemplary conducting contact points in accordance with some embodiments of this disclosure. Conducting contact point(s) 2001 and/or 2003 may have any shape (e.g., a curved surface, a plane surface, a waved surface, or a stepped surface) for a larger contact area.

As shown in FIG. 20A, conducting contact point 2001 may have a curved surface. As shown in FIG. 20B, conducting contact point 2003 may have a stepped surface.

In some embodiments, a conducting contact point (e.g., 2001, 2003, etc.) may have a surface exposed on a surface of plug body. The surface may be a curved surface, a stepped surface, etc. The exposed surfaces of different conducting contact point (e.g., 2001, 2003, etc.) may be the same or different. In some embodiments, two of conducting contact points 2001 may each have a stepped surface, and a third conducting contact point 2001 may have a curved surface. In some embodiments, two of the conducting contact points 2001 may each have a curved surface, and a third conducting contact point 2001 may have a stepped surface.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure or characteristic described in connection with the embodiment is included in at least one embodiment of the present disclosure. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the present disclosure.

Further, it will be appreciated by one skilled in the art, aspects of the present disclosure may be illustrated and described herein in any of a number of patentable classes or context including any new and useful process, machine, manufacture, or composition of matter, or any new and useful improvement thereof.

Furthermore, the recited order of processing elements or sequences, or the use of numbers, letters, or other designations therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose, and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software only solution—e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various inventive embodiments. This method of disclosure, however, is not to be interpreted as reflecting an intention that the claimed subject matter requires more features than are expressly recited in each claim. Rather, inventive embodiments lie in less than all features of a single foregoing disclosed embodiment.

In some embodiments, the numbers expressing quantities of ingredients, properties, used to describe and claim certain embodiments of the application are to be understood as being modified in some instances by the term "about," "approximate," or "substantially." For example, "about," "approximate," or "substantially" may indicate ±20% variation of the value it describes, unless otherwise stated. Accordingly, in some embodiments, the numerical parameters set forth in the written description and attached claims are approximations that may vary depending upon the desired properties sought to be obtained by a particular embodiment. In some embodiments, the numerical parameters should be construed in light of the number of reported significant digits and by applying ordinary rounding techniques.

Notwithstanding that the numerical ranges and parameters setting forth the broad scope of some embodiments of the application are approximations, the numerical values set forth in the specific examples are reported as precisely as practicable.

Each of the patents, patent applications, publications of patent applications, and other material, such as articles, books, specifications, publications, documents, things, and/or the like, referenced herein is hereby incorporated herein by this reference in its entirety for all purposes, excepting any prosecution file history associated with same, any of same that is inconsistent with or in conflict with the present document, or any of same that may have a limiting affect as to the broadest scope of the claims now or later associated with the present document. By way of example, should there be any inconsistency or conflict between the descriptions, definition, and/or the use of a term associated with any of the incorporated material and that associated with the present document, the description, definition, and/or the use of the term in the present document shall prevail.

In closing, it is to be understood that the embodiments of the application disclosed herein are illustrative of the principles of the embodiments of the application. Other modifications that may be employed may be within the scope of the application. Thus, by way of example, but not of limitation, alternative configurations of the embodiments of the application may be utilized in accordance with the teachings herein. Accordingly, embodiments of the present application are not limited to that precisely as shown and described.

What is claimed is:

1. A power plug comprising:

a plug insert having: a handle;

a plug body comprising a plurality of insulation layers and a plurality of conducting strips sandwiched between the plurality of insulation layers; and each of the plurality of conducting strips having, an end extending into the handle and the other end forming or electrically connected to a conducting contact point exposed on a surface of the plug body;

wherein an insulation layer of the plurality of insulation layers comprises a conducting hole on the insulation layer.

2. The power plug of claim 1 comprising three conducting strips forming or electrically connected to three conducting contact points, wherein the three conducting contact points are electrically connected to a hot wire, a neutral wire, and a ground wire, respectively.

3. The power plug of claim 1, wherein the number of the conducting contact points is at least two, and the at least two of the conducting contact points are formed on a same surface of the plug body.

4. The power plug of claim 1, wherein the number of the conducting contact points is at least two, and the at least two conducting contract points are formed on different surfaces of the plug body.

5. The power plug of claim 1, wherein at least one conducting contract point is formed on a bottom surface of the plug body.

6. The power plug of claim 1, wherein at least one of the conducting contact points is retractable.

7. The power plug of claim 1, wherein the handle comprises a wiring path, and the end of a conducting strip extending to the handle extends into the wiring path in the handle.

8. The power plug of claim 7, further comprising a connector having a cross-section that matches a cross-section of at least a portion of the wiring path in the handle, wherein the connector further comprises a plurality of electrical connecting strips, and the electrical connecting strips of the connector and the plurality of conducting strips of the plug insert are electrically connected to form a power port.

9. The power plug of claim 8, wherein the connector further comprises a bulge in the cross-section that matches the cross-section of at least a portion of the wiring path so that the connector is secured in the handle.

10. A power plug comprising:

a connector having an insertion column, a plurality of outer contact points formed on the insertion column, and a power port formed on the connector; and a plug insert having: a handle with an insertion opening matching the insertion column, the insertion opening having a plurality of inner contact points formed inside the insertion opening; and a plug body with a plurality of conducting contact points formed on one or more surfaces of the plug body;

wherein the plug body comprises a plurality of conducting strips formed inside the plug body, each conducting strip having a first end and a second end, the first end forms or is electrically connected to a conducting contact point, and the second end extends into the insertion opening to form or be electrically connected to an inner contact point of the plurality of inner contact points;

wherein the connector comprises a plurality of electrical connecting strips formed inside the connector, each of the electrical connecting strips.

11. The power plug of claim 10 further comprising:

a plurality of insertion grooves formed on an inner wall of the insertion opening, the number of the plurality of insert grooves equals to the number of the plurality of outer contact points;

a plurality of slots formed near the bottom of each insertion groove, the plurality of slots having a plurality of inner contact points formed on the bottom surface of the plurality of slots; and wherein the slots are configured to accommodate the insertion grooves.

12. The power plug of claim 11, wherein each of the electrical connecting strips has a third end and a fourth end, the third end forming or electrically connected to an outer conducting contact point on the insertion column, and the fourth end forming a power port in the connector.

13. The power plug of claim 10, wherein the number of the plurality of conducting contact points is at least two, and the at least two of the conducting contact points are formed on a same surface of the plug body.

14. The power plug of claim 10, wherein the number of the plurality of conducting contact points is at least two, and the at least two conducting contract points are formed on different surfaces of the plug body.

15. The power plug of claim 10, wherein at least one conducting contract point is formed on a bottom surface of the plug body.

16. The power plug of claim 10, wherein the plurality of conducting contact points are retractable.

17. The power plug of claim 10 further comprising a plurality of outer contact circles formed on an upper edge of the insertion column; and a plurality of inner contact circles formed on an upper edge of the insertion opening, wherein the plurality of conducting contact points are connected to at least two of the insertion opening, the plurality of inner contact circles, and the plurality of outer contact circles.

18. The power plug of claim 17, wherein the plug body comprises three conducting strips formed inside the plug body, each conducting strip has a fifth end and a sixth end, the fifth end forming or electrically connected to a conducting contact point on a surface of the plug body, and the three sixth ends of the three conducting strips forming the insertion opening, the inner contact point, and the inner contact circle, respectively.

* * * * *